US006174230B1

(12) United States Patent
Gerrity et al.

(10) Patent No.: US 6,174,230 B1
(45) **Date of Patent: *Jan. 16, 2001**

(54) METHOD AND APPARATUS FOR CONDITIONING COINS PRIOR TO DISCRIMINATION

(75) Inventors: Dan Gerrity, Bellevue; Aaron Finch, Seattle; Chris Ferguson, Redmond; Scott Scherer, Seattle; Rick Riday, Redmond; Larry D. Cannon, Bothell, all of WA (US)

(73) Assignee: Coinstar, Inc., Bellevue, WA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/042,784

(22) Filed: Mar. 17, 1998

Related U.S. Application Data

(63) Continuation of application No. 08/807,340, filed on Feb. 28, 1997, now Pat. No. 5,842,916.

(60) Provisional application No. 60/012,964, filed on Mar. 7, 1996.

(30) Foreign Application Priority Data

Feb. 28, 1997 (WO) ..... PCT/US97/03136

(51) Int. Cl.[7] ..... G07D 1/00

(52) U.S. Cl. ..... 453/57; 453/63

(58) Field of Search ..... 453/3, 5, 8, 57, 453/63; 194/216, 217, 218, 317, 318, 344

(56) References Cited

U.S. PATENT DOCUMENTS

| | | | | |
|---|---|---|---|---|
| 2,398,955 | | 4/1946 | O'Toole | 133/3 |
| 3,147,839 | * | 9/1964 | White | 194/317 |
| 3,196,887 | | 7/1965 | White, Jr. | 133/3 |
| 3,788,440 | | 1/1974 | Propice et al. | 194/99 |
| 4,360,034 | | 11/1982 | Davila et al. | 133/3 D |
| 4,376,442 | | 3/1983 | Gomez et al. | 133/3 C |
| 4,383,540 | | 5/1983 | DeMeyer et al. | 133/3 H |
| 5,564,546 | | 10/1996 | Molbeck et al. | 194/216 |
| 5,620,079 | | 4/1997 | Molbek | 194/217 |

FOREIGN PATENT DOCUMENTS

| | | | |
|---|---|---|---|
| WO 96/30877 | 10/1996 | (WO) | G07D/3/02 |

* cited by examiner

*Primary Examiner*—F. J. Bartuska
(74) *Attorney, Agent, or Firm*—Sheridan, Ross P.C.

(57) ABSTRACT

A coin conditioner is provided for cleaning or otherwise conditioning coins in a coin discriminator apparatus prior to transfer to a coin sensor. Coins enter through a feed tray and move down the length of a perforated tumbler, preferably without the use of gravity, such as under screw force, mechanical or centrifuigal force. The spinning tumbler is preferably rotated about its longitudinal axis by a motor. In one embodiment, a blower or vacuum draws or moves air from one area to another, with the air preferably being filtered. As coins move through and down a tumbler, projections such as vanes, fins, ridges, dimples, spines or other raised features cause mechanical agitation and/or abrasion as coins are lifted and dropped while passing longitudinally through the tumbler. The coins are conditioned and non-coin matter is collected as it is separated and/or abraded from the coin surfaces. Tumbler perforations permit non-coin matter to pass through the perforations into a collection tray or other apparatus and/or are collected into filter media as a result of the air flow. In one embodiment, the air pressure system eliminates or reduces the occurrence of low density or light non-coin matter, such as hair or dust, and prevents these materials from settling or being carried through downstream portions of the coin processing system.

22 Claims, 15 Drawing Sheets

FIG. 17
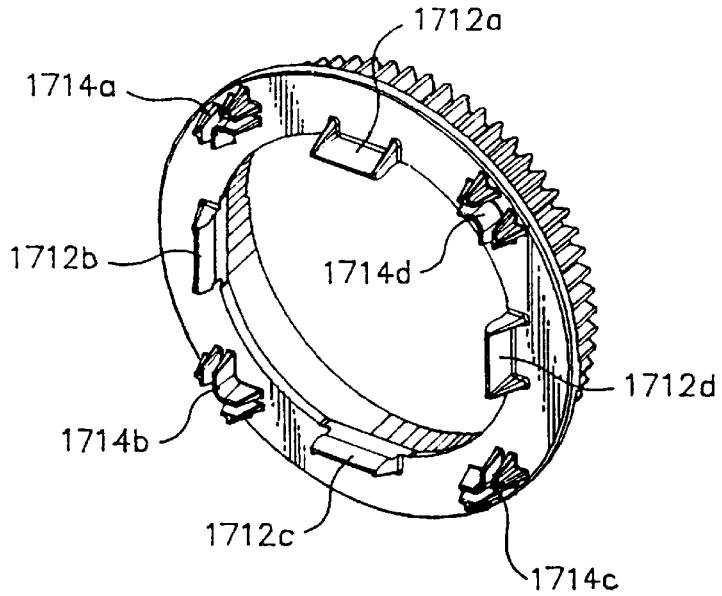
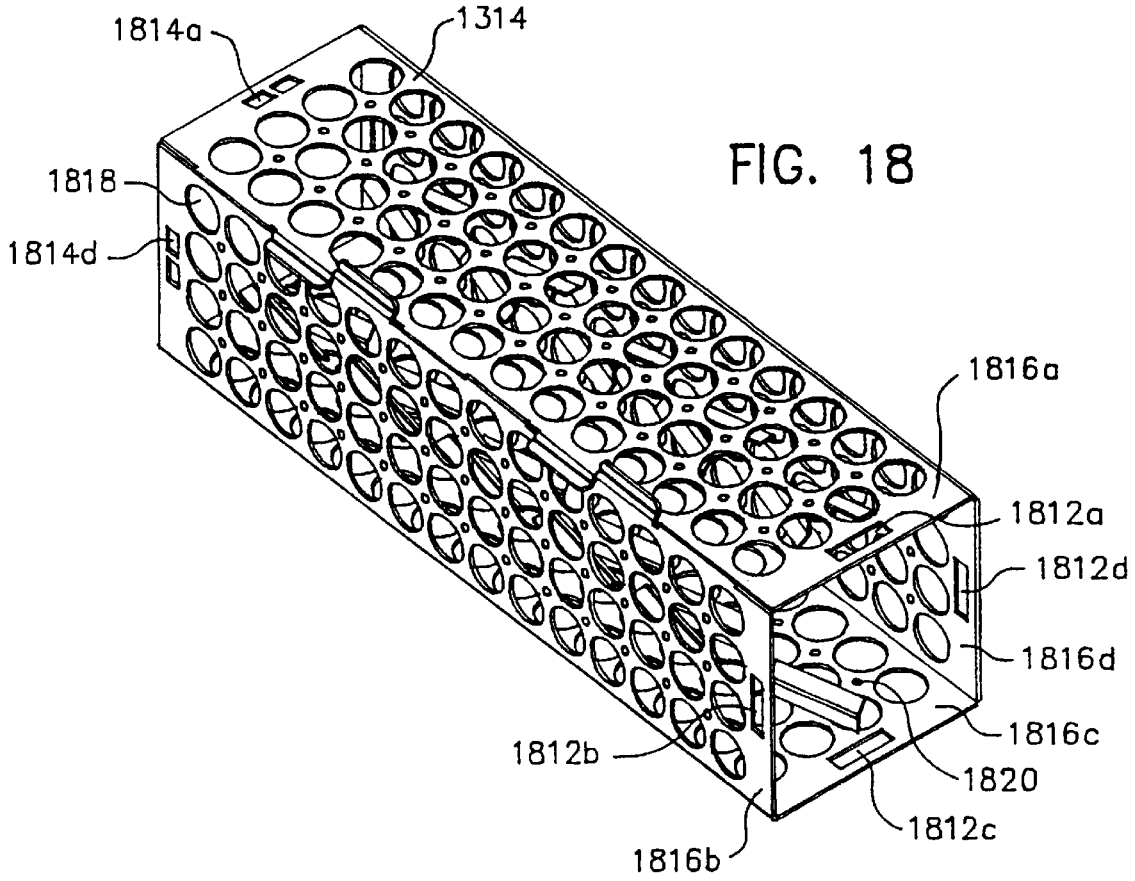
FIG. 18

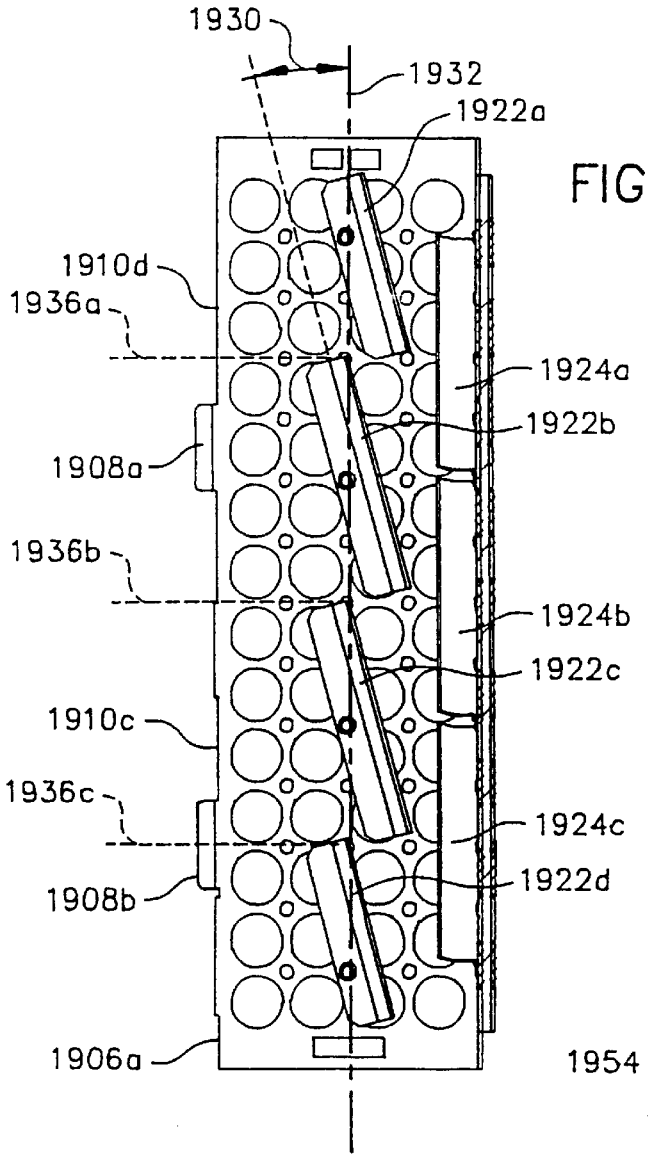
FIG. 19A
FIG. 19E
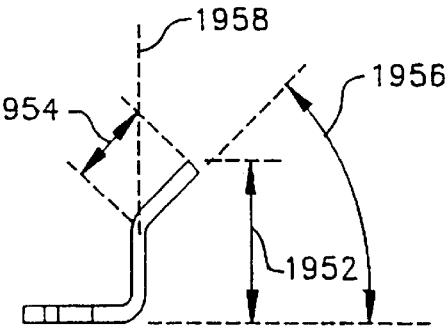
FIG. 19D
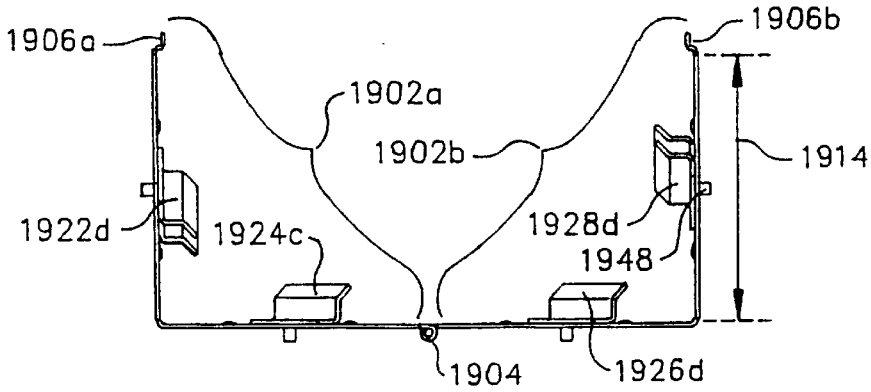

METHOD AND APPARATUS FOR CONDITIONING COINS PRIOR TO DISCRIMINATION

The present application is a continuation of Ser. No. 08/807,340, filed Feb. 28, 1997, now U.S. Pat. No. 5,842,916 and claims priority in U.S. provisional application Ser. No. 60/012,964, filed Mar. 7, 1996 for METHOD AND APPARATUS FOR CONDITIONING COINS PRIOR TO TRANSPORT, SORTING AND COUNTING, The present application also claims priority in PCT application US97/03136, filed Feb. 28, 1997. The entire disclosures of the prior applications are considered to be part of the disclosure of the accompanying application and are hereby incorporated reference.

This invention relates to a device and method for conditioning coins and in particular for removing debris, contamination, corrosion and unwanted materials from coins prior to transport to devices for automatically counting and/or sorting the coins.

BACKGROUND INFORMATION

Coin counting and sorting equipment is often adversely affected by the presence of foreign matter. Mechanical and electronic sorting systems and methods can fail, be damaged, caused to misread and/or become jammed. Mechanical devices such as coin transport mechanisms, coin hoppers and the like may be caused to jam or otherwise malfunction by foreign matter. Sensors may be prevented from accurately identifying a coin because of non-coin matter accompanying the coins. Sensors may become blocked or rendered ineffective because of non-coin matter collecting and or being deposited onto sensor parts. When the sensors fail the coin counting process has failed and coins are often undesirably rejected or are accepted as the incorrect denomination. The amount of non-coin matter varies and is unpredictable. In many situations, the reliability and accuracy of coin sorting, identification and/or counting processes is very inportant and thus the process of removing non-coin matter before the coins are transported to sorting, identification and/or counting sensors is important. The presence of non-coin matter is believed to be especially troublesome in the context of self-service, stand-alone, unmonitored and/or unattended devices, e.g. devices for counting/sorting coins by the general public or other non-trained persons. Accordingly, it would be useful to provide self-service coin processing machinery which can process coins which are accompanied by non-coin matter.

The removal of one type of undesirable non-coin matter does not often eliminate other kinds because the material is so varied. Metal objects may be identified by properties such as density, shape, magnetic characteristics, etc. Typically, removing dense matter such as rocks is entirely different than removing metal or paper objects. Coins may have been stored with materials that have caused corrosion or have become coated with oils, glue and other liquids that collect dirt and other debris. These coins contaminate others as they come into physical contact and may cause adhesion, clumping or grouping of coins. A magnetic separator would not eliminate all this various non-coin matter.

SUMMARY OF THE INVENTION

The present invention provides for separating non-coin objects from coins in a coin-sorting, discriminating or counting device, preferably prior to coins reaching certain coin transport devices, such as transport devices for transporting coins toward a hopper or sensor, preferably prior to coins reaching a coin hopper which provides coins to sensors and preferably prior to the coins reaching the counter/sorting sensors. In one embodiment the separation device is a generally tubular or concave surface, having one or more openings through which non-coin objects travel, and which cause coins introduced thereto to undergo relative movement to assist in separation of non-coin objects. In one embodiment, the relative movement preferably involves lifting some coins with respect to others and may be achieved by pivoting or rotating the tubular or concave surface, e.g., about an axis. Agitation may be further enhanced by projections formed in or attached to the surface, such as vanes, fins, blades, spines, dimples, ridges, and the like. Movement of coins through or across the tubular or concave surface may be effected or enhanced by various mechanisms. Although gravity feed may be used, in one embodiment blades such as angled, spiral or helical blades assist in moving the coins e.g. in a screw conveyor fashion.

Except for coin entrance and exit ports, diameters, sizes or shapes of the openings are configured to prevent passage therethrough of the smallest coin intended to be counted by the counting device. In one embodiment, a drive mechanism rotates the cylinder about its longitudinal axis to agitate the coins therein by lifting coins and, preferably, moving the coins through the cylinder by a screw mechanism.

BRIEF DESCRIPTION OF THE DRAWINGS

FIG. 17 is a perspective view of a first end cap which may be used in connection with an embodiment of the present invention;

FIG. 18 is a perspective view of a trommel body, according to an embodiment of the present invention;

FIGS. 19A–D are right side elevational, top plan, left side elevational and end views of a trommel body in open configuration, according to an embodiment of the present invention;

FIG. 19E is a side view of a vane which may be used in connection with an embodiment of the present invention;

DETAILED DESCRIPTION OF THE PREFERRED EMBODIMENTS

Figure 1:
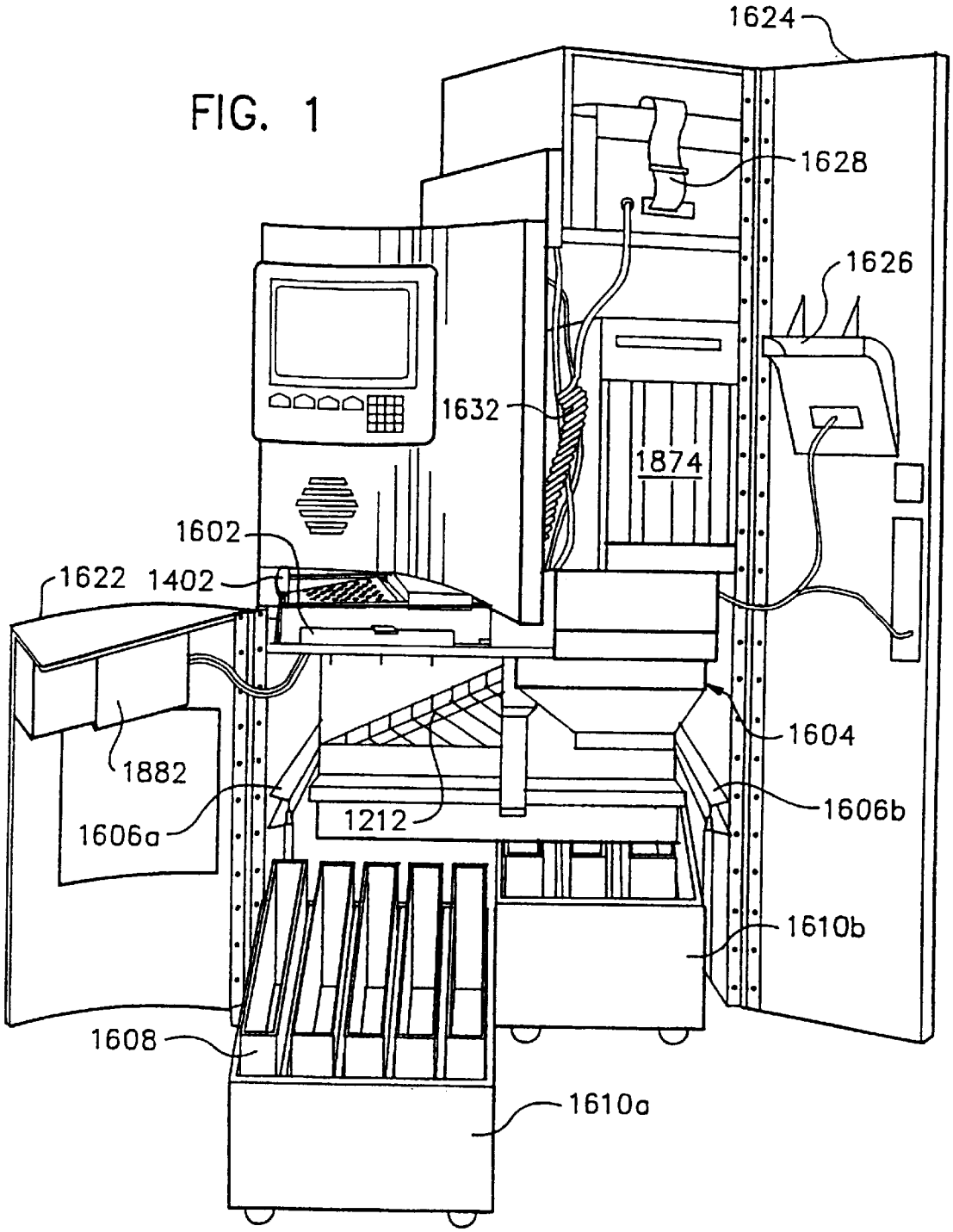
FIG. 1 is a perspective view of a coin-counting device of a type which may be configured to incorporate features of the present invention.

FIG. 1 depicts a coin-counting device which may incorporate features of the present invention. FIG. 1 depicts a device in perspective with various doors opened, and a bag trolley 1610*a* partially withdrawn. In the embodiment of FIG. 1 a coin tray 1402 is mounted pivotally about axis 1414 (FIG. 2), so that a user, after inserting coins in the tray 1402 may lift the tray, using handle 1404, to move coins out of the tray area 1424, over the ridge or peak 1414, and onto a slope 1428, for movement past a gate 1432, and onto a ribbed chute 1406. Coins are moved into a hopper 1604 for transfer to a counter or sorter 1212, where sorted or counted coins are diverted to bin of, in the embodiment of FIG. 1, bags 1608 held in the trolley 1610*a,* 1610*b.* Information processing and/or communication devices and/or printers or dispensers 1628, 1874, which may include, e.g., a computer and/or printer may be provided for outputting information about the sorted coins or counted coins, as described, for example, in PCT application PCT/US95/05356 filed May 1, 1995, and/or U.S. application Ser. No. 08/255,539 filed Jun. 6, 1994, both of which are incorporated herein by reference.

Although the invention is described herein in the context of a device for discriminating or handling coins, the device can generally be applied to separating small, typically unwanted matter or material from larger items. For purposes of the following discussion, the smaller separated items or material (which can include e.g., without limitation, dust, sand, lint, paper, hair, liquids, and myriad other items) will be referred to from time to time herein generically as "dirt" with the understanding that many types of small items or materials, some of them valuable items or materials, can be separated using the present invention.

Figure 2:
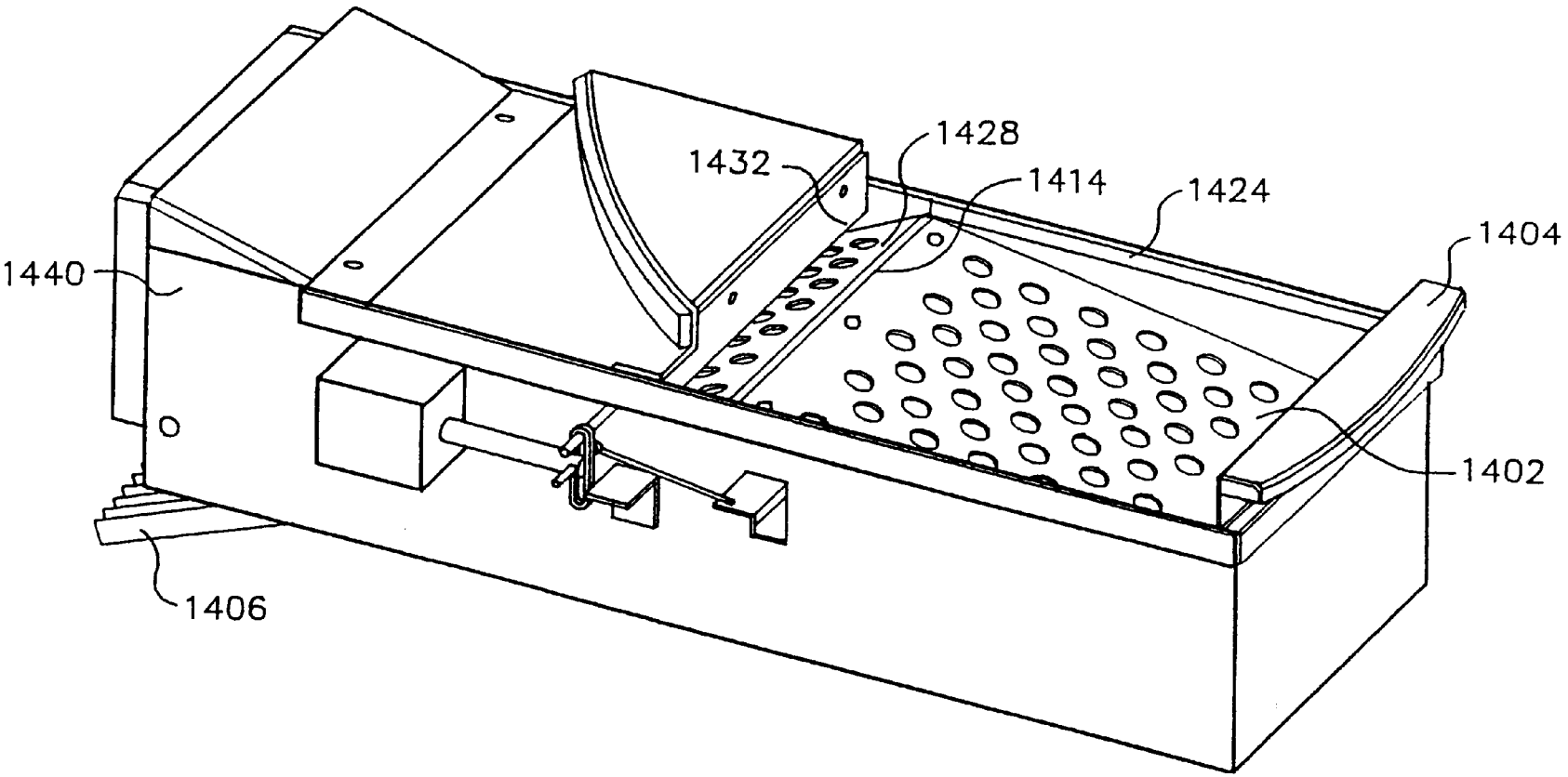
FIG. 2 is a rear perspective view of a receiving tray and rib slide of a type which may be provided in the apparatus of FIG. 1.

While the device of FIG. 2 has proved to be useful and can assist, to at least some degree, in removing non-coin matter from a batch or plurality of coins deposited in the tray 1402, e.g., thought perforations therein and/or traveling over the chute 1406 (e.g., by perforations therein). It is believed additional improvements in preparing coins for counting/sorting can be achieved by incorporating a device which lifts or otherwise moves coins, relative to one another, to assist in separating non-coin matter.

In general, FIGS. 3 through 12 and FIGS. 13 through 21 illustrate different embodiments of the present invention, with the understanding that the illustrated embodiments are not necessarily either mutually exclusive (since features or aspects of one embodiment might be incorporated or substituted into another embodiment), nor incompatible (in the sense that some features or aspects of the invention may be common to more than one embodiment).

Figure 13:
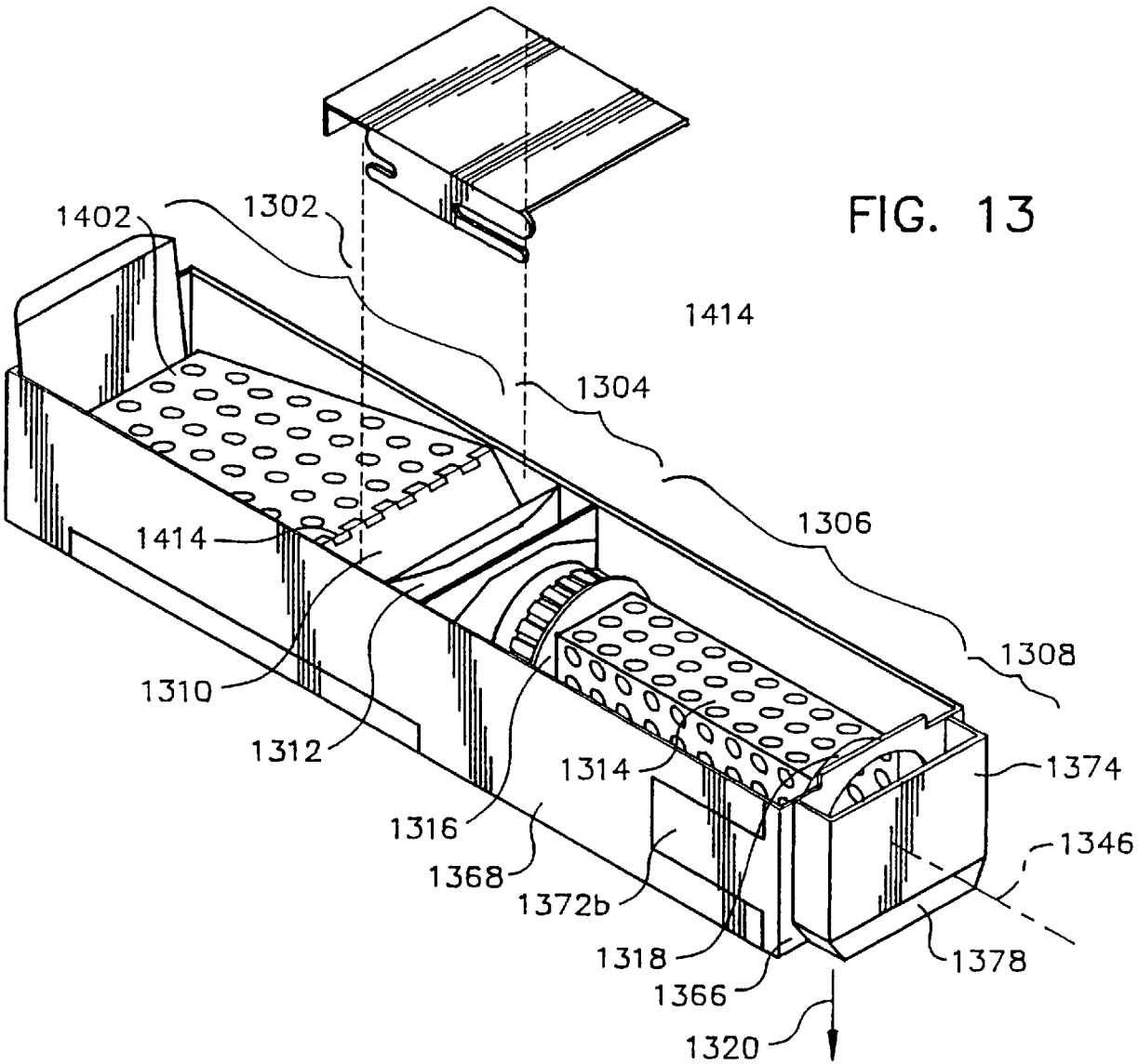
FIG. 13 is a front perspective view, with exploded cover plate, of an apparatus according to an embodiment of the present invention.

In the embodiment depicted in FIG. 13, a device is illustrated which may be generally considered in four sections: an input tray section 1302, a trommel feel section 1304, a trommel section 1306, and trommel output section 1308. The illustrated input tray section 1302 is substantially similar to that described in U.S. Pat. Ser. No. 08/255,539 (now U.S. Pat. No. 5,564,546) and/or PCT/US95/05356, and as described briefly above. The trommel feed region 1304 contains, in the illustrated embodiment, a first chute 1310, and a second chute 1312 for conveying coins and other materials to an input opening of the trommel (described below). The trommel feed region 1304 may contain devices for performing additional functions such as stops or traps, e.g., for dealing with various types of elongate objects, a gate for controlling flow of coins and other objects, lights or other signaling devices, e.g., for prompting input of coins or cessation thereof, and/or drive devices or otherwise for rotating or otherwise moving the trommel as described below. The trommel region 1306 contains a perforated-wall trommel 1314 rotatably mounted via end caps 1316, 1318, which preferably contain bearing surfaces. The trommel output region 1308 provides an output chute for directing the (at least partially) cleaned coins exiting the trommel in a desired direction 1320, e.g., towards a hopper 1604 or similar device.

Figure 15:
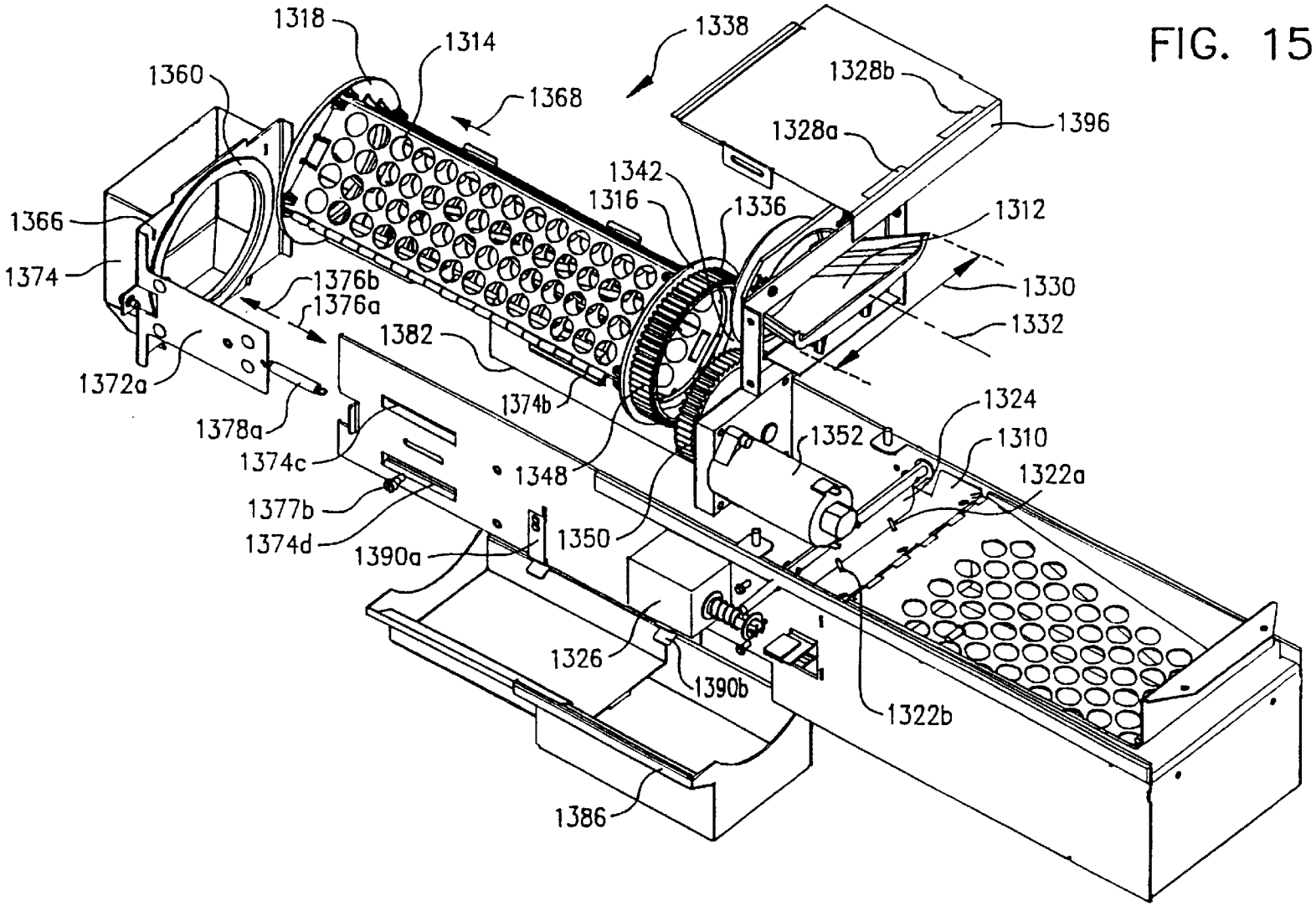
FIG. 15 is a rear perspective view, partially exploded, of the apparatus of FIG. 13.

As best seen in FIG. 15, the first chute 1310 may be provided with first and second pins 1322*a*, 1322*b*. The pins 1322*a,* 1322*b* are provided to block passage of elongate flexible items such as lottery tickets, cardboard, paper and the like. The spacing between the pins 1322*a,* 1322*b* or between the pins and the sides of the chute 1310, determines the size of the largest item which may be allowed to pass. In one embodiment, the pins are positioned to allow a coin with a diameter of about 34 mm to pass, but to block items larger than about 34 mm. In one embodiment, the tray 1310 is stainless steel and the pins 1322*a,* 1322*b* are steel pins welded to the chute 1310. Although two pins are depicted, More or fewer pins could be provided, it being understood, however, that pins tend to slow down coin feed rates somewhat. In the depicted embodiment, the pins 1322*a,* 1122*b* are about two inches (about 5 cm) apart, disposed symmetrically of the center line of the first chute 1310. In the depicted embodiment, the pins are about 0.5 inch (about 12 mm) high.

A controllable gate 1324 is mounted transverse to the first chute 1310 to permit rotation from the closed configuration depicted in FIG. 15, blocking passage of coins, to an open configuration permitting passage of coins or other objects past the gate. Preferably the gate 1324 is formed of rubber, e.g. to avoid pinching of fingers. Rotation of the gate 1324 is controlled by a solenoid 1326. The solenoid 1325 is activated in response to a signal from a control device such as a computer or other information processing device 1628, 1874 (FIG. 1). The gate may be controlled to open or close for a number of purposes, such as in response to sensing of a jam, sensing of load in the trommel or hopper, and the like. In the depicted embodiment, signal devices such as LED or other lights 1328*a,* 1328*b,* can provide a user with an indication of whether the gate 1324 is open or closed (or otherwise to prompt the user to feed or discontinue feeding coins or other objects). Although instructions to feed or discontinue may be provided on the computer screen (FIG.

1), indicator lights 1328 are believed useful since users often are watching the throat of the chute 1310, rather than the computer screen, during the feeding of coins or other objects.

Downstream of the first chute 1310 and gate 1324 is a second chute assembly 1312. Preferably, the second chute 1312 provides a funneling effect by having a greater width 1330 at its upstream edge than its downstream edge. Preferably, the coins cascade or "waterfall" when passing from the first chute 1310 to the second chute 1312, e.g. to increase momentum and tumbling of the coins. In one embodiment the width at the upstream edge is about 5.2 inches (about 13 cm), and the width at the downstream edge is about 2.5 inches (about 6 cm). Preferably, the depth of the chute increases in the directional flow, such as providing a depth of about one inch (about 2.5 cm) at the upstream edge, and a depth of about 1.5 inches (about 3.8 cm) at the downstream edge.

Preferably, the chute 1312 is configured to facilitate coin travel, e.g., by reducing or eliminating the effects of friction, surface tension, and the like. Preferably, the chute 1312 upper surface has no flat region large enough for a coin to contact the surface over one of the faces of the coin, i.e., preferably the coin which touches the chute 1312 preferably makes contact on, at most, two points. Preferably, the surface of the chute 1312 is constructed such that it has a finite radius of curvature along any plane normal to its longitudinal axis 1332, and preferably with such radii of curvature increasing in the direction of coin flow.

Preferably the chute 1312 has an upper surface which is substantially smooth and free from protrusions, ridges, throughholes or other holes, and the like. In one embodiment the chute 1312 is formed from injected molded plastic such as an acetal resin or plastic, a polyamide polymer, such as a nylon, Delrin®, available from E.I. DuPont de Nemours & Co., and the like. Other materials that can be used for the chute include metals, ceramics, fiberglass, reinforced materials, epoxies, ceramic-coated or -reinforced materials and the like.

Figure 14:
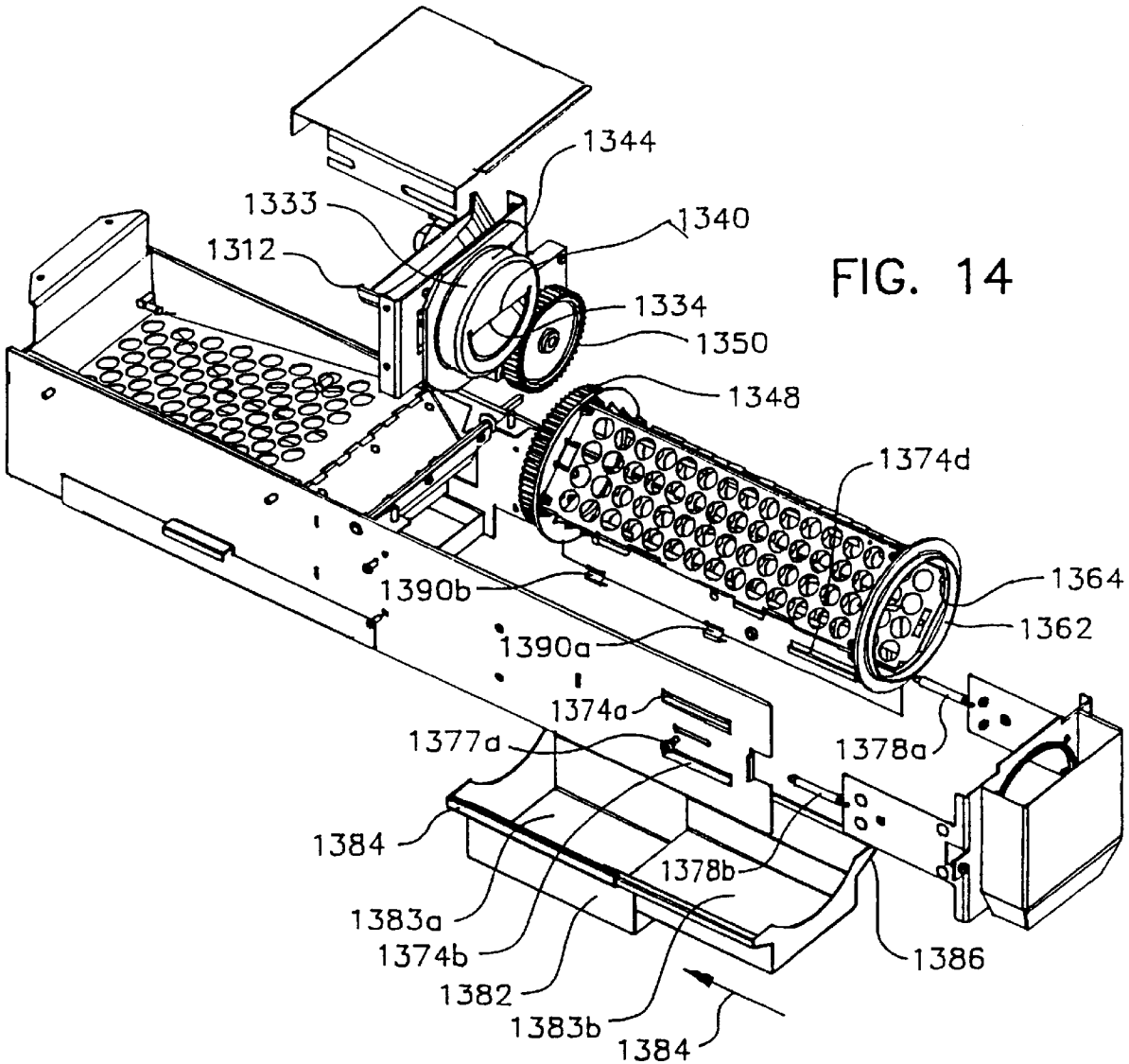
FIG. 14 is a front perceive view, partially exploded, of the apparatus of FIG. 13.
Figure 16:
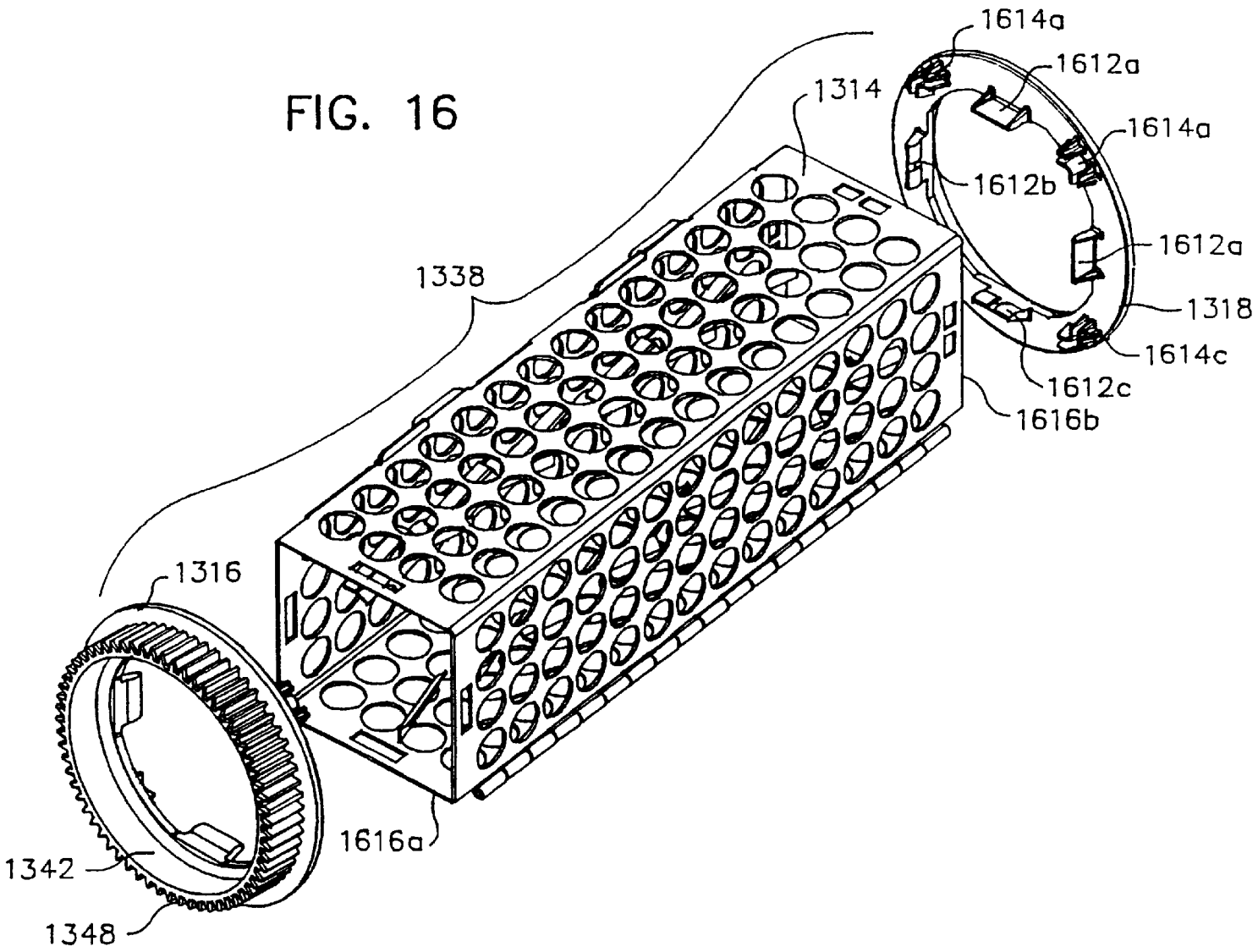
FIG. 16 is a perspective view, partially exploded, of a trommel assembly, according to an embodiment of the present invention.
Figure 19B:
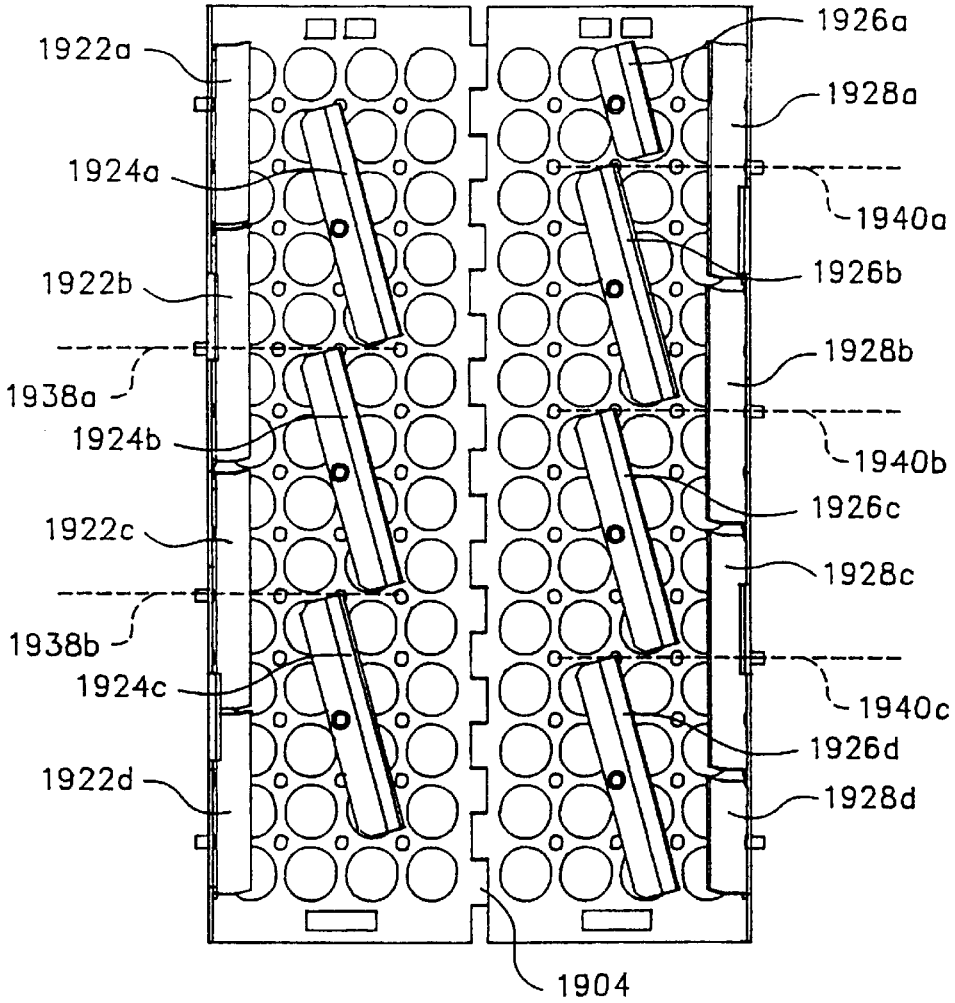
Figure 20:
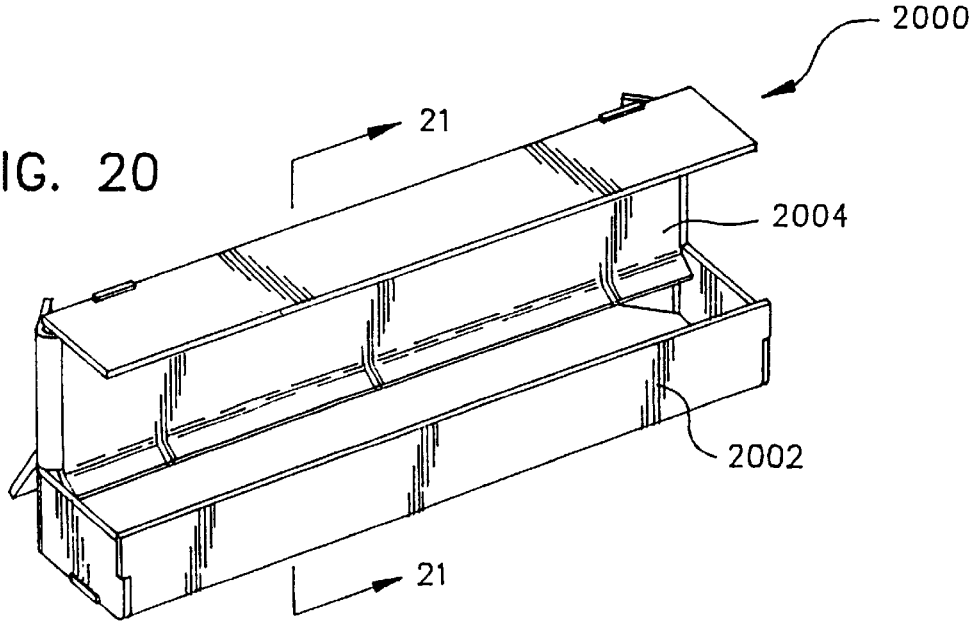
FIG. 20 is a perspective view of a long object trap of a type which may be used in connection with an embodiment of the present invention.
Figure 19C:
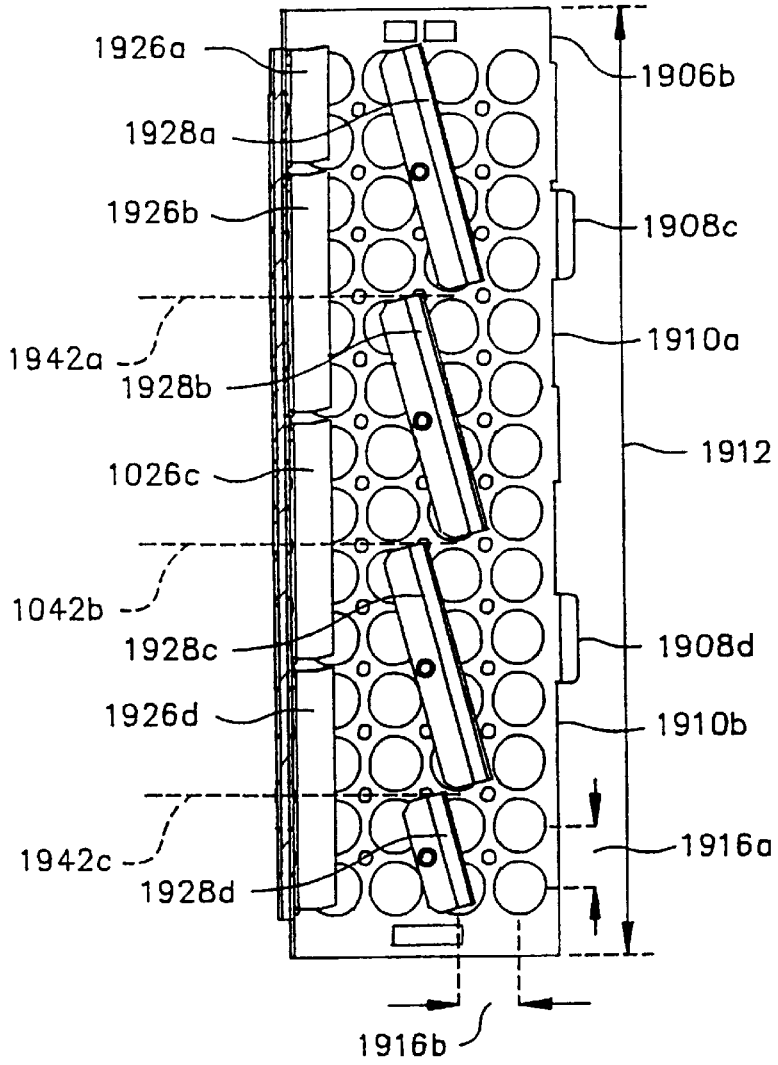

As best seen in FIG. 14, the trough assembly 1312 terminates in a collar 1333 defining a mouth 1334, which is configured to feed coins from the chute 1312 into a first opening 1336 of tile trammel assembly 1338. The mouth 1334 is formed with an upper lip 1340. In the depicted embodiment the first opening 1336 of the trommel assembly 1338 is defined by a first end cap 1316 which is coupled to a trommel body 1314. The first end cap 1316 has a smooth cylindrical bearing surface 1342 configured to mate with a bearing surface 1344 of the chute collar, supporting the rotation of the trommel assembly 1338 about a rotation as 1346 in a manner described more fully below. An exterior surface of the first end cap 1316 is geared 1348 to mesh with a drive gear 1350 powered by a drive motor 1352. The drive gear 1350 is preferably spaced from the stationary bearing 1344 sufficiently to permit manual engagement of the end cap gear 1348 with the drive gear 1350 and simultaneous mating of the first end cap bearing 1342 with the stationary bearing 1340 by merely grasping the trommel assembly 1338, aligning it with the collar 1333 (preferably facilitated by a bevel), rotating the trommel assembly 1338 about its longitudinal axis as needed to mesh the gears 1348, 1350, and pushing towards the chute collar 1333. Similarly, the trommel assembly 1338 may be manually disengaged from the drive gear 1350 and bearing 1344 by pulling in a direction away from the chute collar 1333. Preferably, as best seen in FIGS. 16 and 17, the end cap 1316 includes resilient tabs 1712*a*, 1712*b*, 1712*c*, 1712*d* for engaging slots 1812*a*, 1812*b*, 1812*c*, 1812*d*, respectively, and tabs 1714*a*, 1714*b*, 1714*c*, 1714*d* for capturing corners of the trommel 1314.

A similar system of tabs 1612*a*, 1612*b*, 1612*c*, 1612*d*, 1614*a*, 1614*b*, 1614*c*, 1614*d* engage and capture slots 1814*a*, 1814*b*, 1814*c*, 1814*d*, and comers of the downstream end of the trommel 1314. Preferably, the tab and slot system 1712*a*, 1712*b*, 1712*c*, 1712*d*, 1812*a*, 1812*b*, 1812*c*, 1812*d*, or the trommel 1314 and first end cap 1316 are different from the tabs 1612*a*, 1612*b*, 1612*c*, 1612*d*, 1814*a*, 1814*b*, 1814*c*, 1814*d* of the second end cap 1318 in such a manner that the end caps 1316, 1318 are coupled to the first and second ends 1616*a*, 1616*b* of the trommel 1314, respectively, and not the other way around. In the depicted embodiment, the downstream tabs and slots have dual protrusions and openings corresponding to the single protrusions and openings of the upstream tabs and slots. Preferably, the resiliency of the tabs 1712A, -B, -C, -D, 1612A. -B, -C, -D is such that the end caps 1316, 1318 remain securely coupled to the trommel 1314 during normal use, but may be manually removed without the use of special tools, preferably without the use of any tools, e.g., for cleaning, as described below. Preferably, the end caps 1316, 1318 are formed of a plastic material such as an acetal plastic, nylon, Derlin® and the like. Preferably, when both the end caps 1316, 1318 and the bearing surfaces 1344, 1360 are formed of plastic, different plastics are used for mating bearing surfaces, such as by forming the end caps 1316, 1318 of Delrin® and the bearing surfaces 1344, 1360 of a nylon. This is believed to reduce friction and facilitate rotation of the trommel.

As best seen in FIG. 18, the trommel 1314 is shaped to define four rectangular walls 1816*a*, 1816*b*, 1816*c*, 1816*d* to define a substantially square cross section. In the view of FIG. 18, interior vanes have been removed, for clarity. The trommel 1314 provides at least one hole for permitting passage or exit of dirt from the trommel and, preferably, as depicted, includes a plurality of such holes 1818. The holes 1818 are sufficiently small to prevent passage of the smallest coins (or other object to be discriminated). In one embodiment when the device is used in connection with U.S. coins, the holes 1818 have a diameter of about 0.61 inches (about 1.5 mm) to prevent passage of U.S. dimes. In the depicted embodiment, the holes have an inter-row and inter-column spacing 1916*a*, 1916*b* of about 0.7 inches (&bout 18 mm). The number, density and distribution of holes 1818 can be configured in a number of ways, other than that depicted. Many factors affect the choice of the number, size, density and distribution of hole. For example, the configuration of the holes affects the overall strength and stability of the trommel 1314 and thus the configuration of the holes may be modified to accommodate the characteristics of different materials used for forming the trommel 1314. The configuration depicted in FIG. 18 is generally believed to provide a relatively large, total hole area (to facilitate removal of dirt) while maintaining the desired structural integrity and sturdiness of the trommel 1314. The depicted distribution of holes in rows and columns is believed to contribute to stability, although other configurations are also possible, such as hexagonally-centered holes, randomly positioned holes, and the like. Although in the configuration of FIG. 18 all the holes are of the same size, it is possible to provide holes in various sizes (smaller than the largest hole which prevents passage of the smallest coin to be treated). Although it is preferred to distribute holes 1818 over substantially the entire inner surface of the trommel 1314, it would be possible, if desired, to position holes such that some areas of the trommel are substantially free from holes.

In the depicted embodiment dimples 1820 are formed protruding slightly into the interior region of the trommel 1314. The dimples 1820 are believed to facilitate throughput by avoiding adhesion (such as surface tension—induced adhesion) and/or friction between coins and the interior surface of the trommel. The dimples are believed to reduce the likelihood of adhering a customer's coins to the trommel wall, resulting in loss of credit to the customer. It is believed the dimples prevent or reduce surface-to-surface contact of coins with an interior surface of the trommel over a substantial region of the coin face surface and, accordingly, in the depicted embodiment, dimples 1820 are positioned in any location of the interior grace where a flat region of substantial area would otherwise occur (such as regions between holes). Other shapes, sizes, locations and distributions of protrusions, ridges, fingers, and the like may also be useful to facilitate throughput.

A configuration of a trommel according to one embodiment of the invention is illustrated in FIGS. 19A through 19D. In the depicted embodiment, the trommel is formed from two halves 1902*a,* 1902*b,* rotationally coupled, e.g. by a hinge, such as a piano hinge 1904 or other rotational device such as clips, screws, interconnecting tabs and slots, and the like. The hinge 1904 permits the two halves 1902*a,* 1902*b* to be reconfigured in a "clam shell" fashion between the closed operating configuration depicted in FIG. 18, and an open configuration (e.g., for maintenance) depicted in FIGS. 19A through 19D. The edges 1906*a,*. 1906*b* diagonally opposed to the hinge 1904 are fitted with latching devices such as tabs 1908*a,* 1908*b,* 1908*c,* 1908*d,* which resiliently latch, in an interference fashion, with corresponding regions 1910*a,* 1910*b,* 1910*c,* 1910*d* of opposing edges. The end caps 16, 1318 further assist in maintaining the trommel in the configuration during operation.

The dimensions of the trommel may be selected depending upon the desired capacity and throughput, as well as the structural requirements for the trommel. In the depicted embodiment, the trommel has a length 1912 of about 10.6 inches (about 27 cm), with each wall having an effective width 1914 of about 2.9 inches (about 7.5 cm).

In general, it is preferred to provide a trommel which causes or at least urges coins, during rotation of the trommel, to freely fall through at least a portion of the interior of the trommel (as opposed to, for example, merely rolling or tumbling in a mass adjacent the lowest surface of the trommel. Thus, preferably the trommel assists in lifting coins, as it rotates, and dropping the coins from an elevated height through at least a portion of the interior of the trommel. Without wishing to be bound by any theory, a number of features of the trommel are believed to contribute to the desired coin lifting/free-fall. It has been found, for example, that a trommel with a circular cross-section tends to result in coins remaining adjacent the lower surface (albeit while tumbling), without substantial lifting or free-fall. It is believed that providing a trommel cross-section which defines flat surfaces and/or comers (i.e., surfaces meeting at an angle) assists in coin lifting/free-fall In the depicted embodiment, the trommel has a substantially square cross-section, thus defining four substantially flat surfaces, and four comers. It is believed that other cross-sections may provide at least some desirable lifting/free-fall, including cross-section which have comers but no flat surfaces, and/or cross-section with more or fewer than four flat surfaces. Cross-sections which are non-regular (such as isosceles triangular cross-sections) or which have local concavities, such as star-shaped cross-sections, may be useful in some contexts. Other potential cross-sections include triangles, pentagons, hexagons, octagons, semicircles, rectangles, inflated or pillowed cross-sectional shapes (such as defined by three or more intersecting circular or elliptical arcs), cross-sections with surfaces defined by various non-linear shapes such as ellipses, parabolas, hyperbolas, and the like. Although the depicted embodiment provides a trommel which has a cross-section that is substantially constant along its longitudinal axis, it is also possible to provide trommels with cross-sections that vary along the longitudinal axis such as tapering or flaring cross-sections. Although a number of trommel configurations are operable and each may provide certain advantages in some circumstances, the depicted configuration is believed to provide at least the advantages of relatively low manufactured cost, easy access, low parts count, wider material choice and ease of design, construction, and maintenance.

Another feature which is believed to contribute to the desired lifting/free-fall behavior of the coins or other objects is a provision of one or more vanes protruding into the interior of the trommel 1922*a,* 1922*b,* 1922*c,* 1922*d,* 1924*a,* 1924*b,* 1924*c,* 1926*a,* 1926*b,* 1926*c,* 1926*d,* 1928*a,* 1928*b,* 1928*c,* 1929*d.* It is believed that by positioning vanes at an angle such as about 15° 1930 to a plane passing through the longitudinal axis 1932, the vanes assist not only in providing coin-lifting/free-fall, but also assist in moving the coins in a direction towards the output region 1308. Although it would be possible to provide one or more vanes whose lateral position (with respect an interior surface of the trommel) changed monotonically, it is believed such configuration is not as effective in assisting with movement of coils towards the output portion 1308, as a configuration in which the lateral position of the vane changes non-monotonically. In the depicted embodiment this is accomplished by providing the vanes in several subparts or segments, defining discontinuities or nodes at longitudinal positions 1936*a,* 1936*b,* 1936*c,* 1938*a,* 1938*b,* 1940*a,* 1940*b,* 1940*c,* 1940*d,* 1942*a,* 1942*b,* 1942*c* therebetween. Without wishing to be bound by any theory, it is believed that a configuration in which the nodes for adjacent sides of the trommel are at similar longitudinal positions does not promote the desired transport of coins towards the output end 1308. Accordingly, the nodes 1936*a,* 1935*b,* 1936*c,* 1938*a,* 1938*b,* 1940*a,* 1940*b* 1940*c,* 1942*a,* 1942*b,* 1942*c,* are preferably configured such that nodes defined on one surface are at longitudinal positions different from the node positions for an adjacent surface and, preferably, different from node positions for all other surfaces, as depicted. In the depicted embodiment, eleven of the fifteen vane segments are the same length (about 2.7 inches or about 6.8 cm in the depicted embodiment), with the desired node offset resulting in the remaining segments 1922*a,* 1922*d,* 1926*a,* 1928*d* being shorter.

In the depicted embodiment, vanes are separately formed and attached to the interior surfaces of the trommel. Preferably, attachment is via tabs (not shown) protruding from the undersurface of the vanes and engaging with slots (not shown) formed in the trommel surfaces. In the depicted embodiment, rivets 1948 are used for attachment. Attachment could also be by interference fit, bolts and nuts, welding, brazing, soldering, adhesives, or vanes may be integrally formed with the trommel. In one embodiment the vanes are formed of a material similar to the material used to form the trommel surfaces, preferably stainless steel, although plastics, fiberglass, ceramics, and the like can also be used.

In one embodiment, as depicted in FIG. 19E, the vanes protrude a distance 1952 into the interior of the trommel of about 0.45 inches (about 1.2 cm). In the depicted embodiment, the upper portion (such as the upper 0.2 inches (about 5 mm) 1954 is angled (e.g., at about 45°) 1956 to a normal 1958 to the adjacent trommel surface. The angled portion 1954 is believed to assist in lifting the coins higher (compared to non-angled vanes) during trommel rotation.

In the depicted embodiment use of vanes for assistance in moving the coins towards the output in 1308 is particularly useful since the depicted configuration shows a substantially horizontal longitudinal axis 1346. If desired, a device can be constructed such that the rotation axis 1346 departs from the horizontal, such as being inclined towards the output end 1308, e.g., to assist in movement of coins towards the output portion 1308. The inclination, or lack thereof, of the rotation axis 1346 is determined by the location of the downstream bearing 1360 which engages the cylindrical bearing surface 1362 of the second end cap 1318. Preferably, the bearing ring 1360 is formed of a plastic material such as a nylon or Delrin® and is preferably formed of a material different from the material of the bearing surface 1362 of the second end cap 1318. The second end cap 1318 defines an opening 1364 through which coins or other objects exit from the trommel assembly 1338.

The output bearing 1360 is held in position by an end wall 1366. In the depicted embodiment, the end wall 1366 is mounted to the frame 1368 so as to permit the end wall 1366 to be moved so as to allow the trommel assembly 1338 to be withdrawn 1368, e.g., for cleaning or maintenance. In the depicted embodiment, the end wall 1366 is coupled to legs 1372*a,* 1372*b* which fit into rails 1374*a,* 1374*b,* 1374*c,* 1374*d,* to permit sliding movement in an engagement direction 1376*a* or disengagement 1376*b* direction Springs 1374*a,* 1374*b,* normally urges the legs 1372*a,* 1372*b,* and thus the wall 1366 in the engagement direction 1376*a*. The springs 1378*a,* 1378*b* are sufficiently strong to securely maintain the trommel assembly 1338 in the engaged position (i.e., the position shown in FIG. 13) during normal operation, but permit the output portion 1309 to be moved in the disengagement direction 1376*b* manually (i.e., without the use of special tools, preferably without the use of any tools) in an amount sufficient to prevent disengagement and withdrawal of the trommel assembly 1338, e.g., for maintenance, cleaning, replacement, inspection, and the like. Preferably, a limit screw 1377*a,* 1377*b* provides a stop to prevent the force of the springs 1378*a,* 1378*b* from causing the bearing 1360 to thrust against the end cap 1318, undesirably increasing friction. In the depicted embodiment, the tray 1382 is formed in two portions 1383*a,* 1383*b,* coupled in a sliding fashion to permit the tray to be collapsed 1385. Collapsing the tray is believed useful in assisting in tray removal, for certain configurations, e.g., where space is restricted. Preferably the tray 1382 has sufficient capacity that tray emptying is required no more often than about once every two weeks, during normal anticipated USC. Other fashions of permitting disengagement or movement of the bearing ring 1360 can be used, such as providing for hinged or pivoting movement. The depicted sliding movement is believed to permit removal of the trommel 1338, e.g., through the open bottom 1382 of the frame, while reducing or minimizing longitudinal space requirements. In the depicted embodiment, and output chute 1374 is provided adjacent the output opening of the trommel. In the depicted configuration the output chute 1374 is configured to direct coins, output from the trommel, in a substantially downward direction 1320. A tapered region 1378 assists in directing the coins.

Preferably, a tray or other container 1382 is located beneath the trommel assembly 1338 to catch dirt which passes through the trommel dirt openings Preferably, the tray 1382 is configured to be easily removed (e.g., for emptying, cleaning, and/or permitting access to the underportion of the device). In the depicted embodiment, the first edge 1384 of the tray 1382 engages a rail or lip 1382 formed on the frame 1368, and the opposite edge 1386 maybe rotated upward to engage with spring clips 1390*a,* 1390*b* on the opposite side of the frame.

Figure 21:
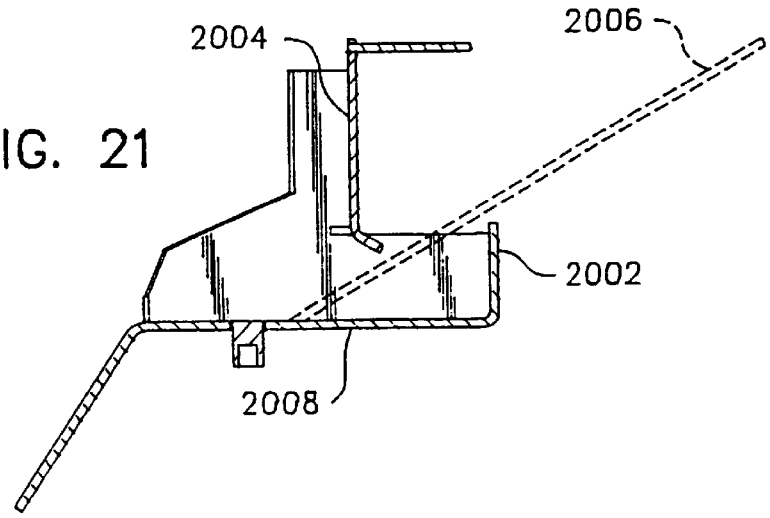
FIG. 21 is a cross sectional view taken along line 21—21 of the device of FIG. 20.

In one embodiment, a long object trap 2000 (FIG. 20) may be positioned between the input tray 1402 and the trommel 1306 to assist in preventing insertion of long, relatively rigid objects such as a popsicle stick, into the trommel. In the depicted embodiment, the long object trap includes a first, upstanding wall 2002 and, somewhat downstream, a second, descending wall 2004. As depicted in FIG. 21, any attempt to insert a rigid elongated object 2006 will result in the object contacting a floor region 2008, preventing further passage.

In operation, the user of the embodiment of FIGS. 13–21 places a mass of coins, preferably all at once (typically accompanied by dirt or other non-coin objects) in the input tray 1402. The user is prompted to push a button to inform the machine that the user wishes to have coins discriminated. Thereupon, the computer causes the input gate 1324 to open (via solenoid 1126) and illuminate a signal to prompt We user to begin feeding coins. When the gate 1324 is open, the motor 1352 is activated to begin rotating the trommel assembly 1338. The user moves coin over the peak defined by the hinge 1414, typically by lifting the tray 1402 at least partially, and/or manually feeding coins over the peak 1414. The coins pass the gate 1396 (typically set to prevent passage of more than a predetermined number of stacked coins, such as by defining an opening equal to about 3.5 times a typical coin thickness). The coins move down the lot trough 1310, where the pins 1322 prevent passage of certain long objects such as lottery tickets and the like. A long object trap (if any) prevents passage of other types of objects such as popsicle sticks. Coins continue to flow down the second trough or chute 1312. Coins travel through the chute collar mouth 1334 and into the interior of the rotating trommel assembly 1338. Within the rotating assembly 1338 the coins are lifted and free-fall, at least partially, through the interior of the trommel, preferably at least partially in response to provision of flat surfaces, corners, and/or vanes within the trommel. As the coins free-fall or are otherwise agitated by the rotating trommel, dirt particles or other non-coin objects pass through the holes of the trommel and fall into the tray 1382. Coins travel through the trommel, e.g., in response to angled disposition of the vanes and the inclination of the trommel, if any. In general is it believed that a larger angle provides for shorter residence time, but less thorough cleaning or lifting of the coins, Thus the angle selection may require a compromise between the desire for thorough cleaning and the desire for short residence time (which contributes to higher throughput). The depicted configuration, when the trommel rotates at about 36 RPM, and using a typical mixture of U. S. coins provides a coin residence time of approximately 10 seconds. Under these conditions, throughput during normal use is believed to be sustainable at about 600 coins per minute or more. Configuration and operating conditions can be adjusted to increase or decrease throughput, e.g., by changing the size, length or capacity of the trommel, increasing rotation rate, changing vane configuration or angles, and the like, within structural constraints for desired durability, lifetime and maintenance costs. The coins, after being at least partially cleaned, exit the second opening 1364 of the trommel, and are directed by the output chute 1374 in an output direction 1320 toward downstream components such as the hopper of a coin transport/discrimination device.

Preferably, operation of the device is monitored, such as by monitoring current draw for the motor 1352. In this configuration, a sudden increase or spike in current draw may be considered indicative of an undesirable load and/or jam of the trommel assembly 1368. The system may be configured in various ways to respond to such a sensed jam such as by turning off the motor 1352 to stop attempted trommel rotation and/or reversing the motor, or altering motor direction periodically, to attempt to clear the jars Jamming or undesirable load can also be sensed by other devices such as magnetic, optical or mechanical sensors. In one embodiment, when a jam or undesirable load is sensed, coin feed is stopped or discouraged, e.g., by closing gate 1324 and/or illuminating a "stop feed" indicator 1328*b*.

Figure 3:
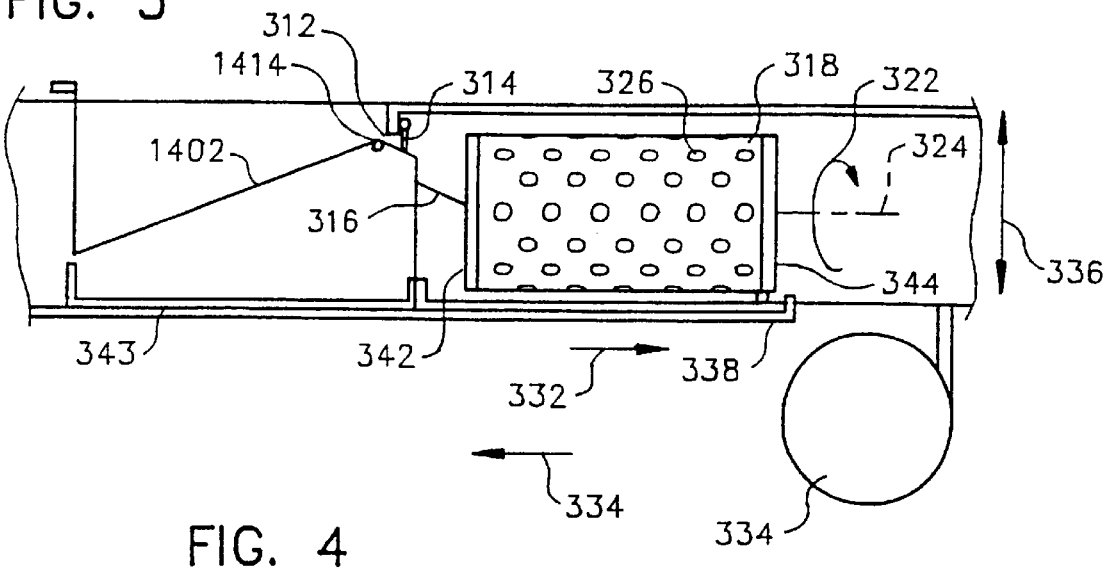
FIG. 3 is a schematic side view of a feed tray and tumbler device according to an embodiment of the present invention.

Turning, now, to the embodiments of FIGS. 3–12, in FIG. 3, the perforated tray 1402 provides a device for moving coins therein (upon lifting the tray 1402 about pivot axis 1414) through a slot 312, pat a gate 314 which may be, e.g., a controllable gate, and via chute 316 into a perforated-wall cylinder 318. Preferably, the perforated wall cylinder 318 is configured to assist in or cause the relative movement of coins introduced thereto, such as by being rotatable in a first direction 322 about its longitudinal axis 324. Various rates of rotation can be used. Preferably, a high feed rate through the cylinder is achieved, such as a rate of at least 100 coins per minute, preferably at least 200 coins a minutes, more preferably at least about 600 coins per minute or more.

Preferably, the perforations or holes 326 formed in the surface or wall of the cylinder 318 are shaped or sized to prevent or avoid passage, through the holes 326, of the smallest coins which are intended to be counted by the counting device. Various hole or opening sizes and shapes are possible, giving due consideration to the size or diameter of the coins and, in some cases, the tumbling speed or rotational velocity. In one embodiment, oblong openings are provided and are believed to be useful, in some embodiments, in further assisting removal of non-coin matter.

Preferably, openings 318 are as large as possible to accommodate large non-coin matter without undesirably diverting or hindering the feed rate of smaller diameter coins. A number of factors may affect the choice of hole sizes. As described below, internal vanes, fins, ridges and other projections may be positioned, e.g., on the inside surface of the cylinder, and there must be sufficient remaining surface to allow these projections to be attached and/or formed. The size of the holes and/or the spacing and/or pattern of the holes may affect the length or load capacity of the cylinder 318. Removing non-coin debris is important, and having a large amount of open surface area (total surface area of all holes in the cylinder 318) tends to increase the effectiveness of eliminating large objects, including large, dense and/or odd-shaped objects. However, the total ma occupied by holes in the drum, while being desirably as large as feasible, should not be so large as to cause the cylinder to lose structural integrity, have a smaller than desired load capacity, and/or be subject to unwanted deflection or failure.

A number of different materials can be used for forming a cylinder 318. In one embodiment, the cylinder may be formed of cast urethane. In one embodiment, longitudinal steel and/or stainless tubing is used for the tumbler cylinder 318. Preferably, the tube is non-magnetic, such as being formed of stainless steel such as T-304, T-316, and/or ELC grade steel. By providing a non-magnetic tumbler, cylinder 318, avoids interfering with devices such as magnets (not shown) that may be provided for eliminating ferrous coins and/or ferrous non-coin matter. The thickness of the drum 318 can be selected to provide a desired coin capacity or load-bearing ability, a desired usable lifetime and/or desired wear factor. In one embodiment the cylinder 318 is constructed from corrugated spiral lock seam tubing. This embodiment is particularly useful in that blades or fins can be configured to be positioned adjacent to the spiral seams, which is believed to offer enhanced strength and/or higher pressure differential, and thus allow a reduction in wall thickness and overall mass of the cylinder over what would otherwise be required. A suitable tubing may be obtained from Perforated Tubes Incorporated of Ada, Michigan.

Figure 4:
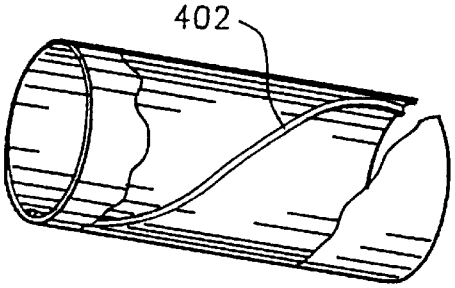
FIG. 4 is a schematic depiction of the position of a helical blade in an embodiment of the present invention.
Figure 6:
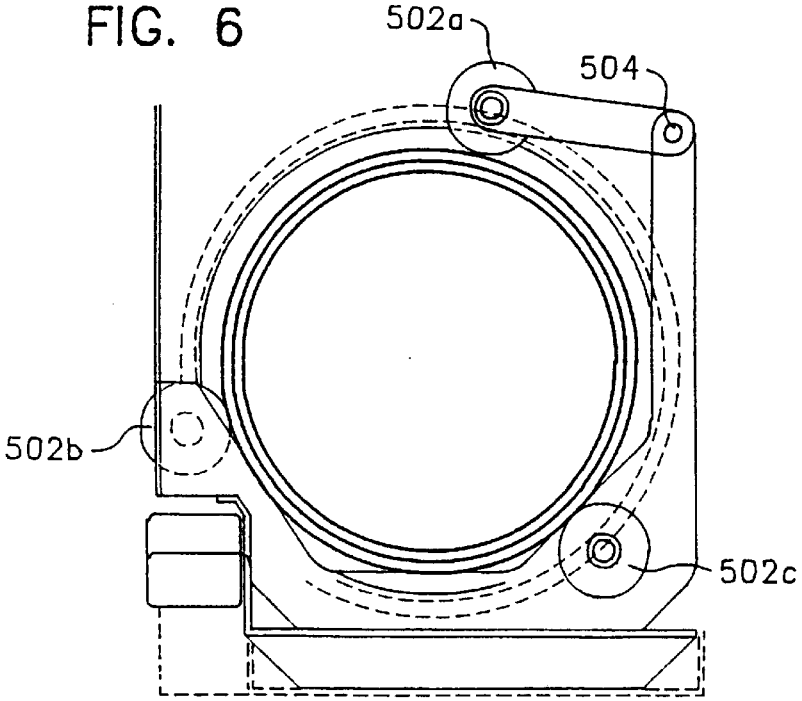
FIG. 6 is an end view of a tumbler device according to an embodiment of the present invention.
Figure 5:
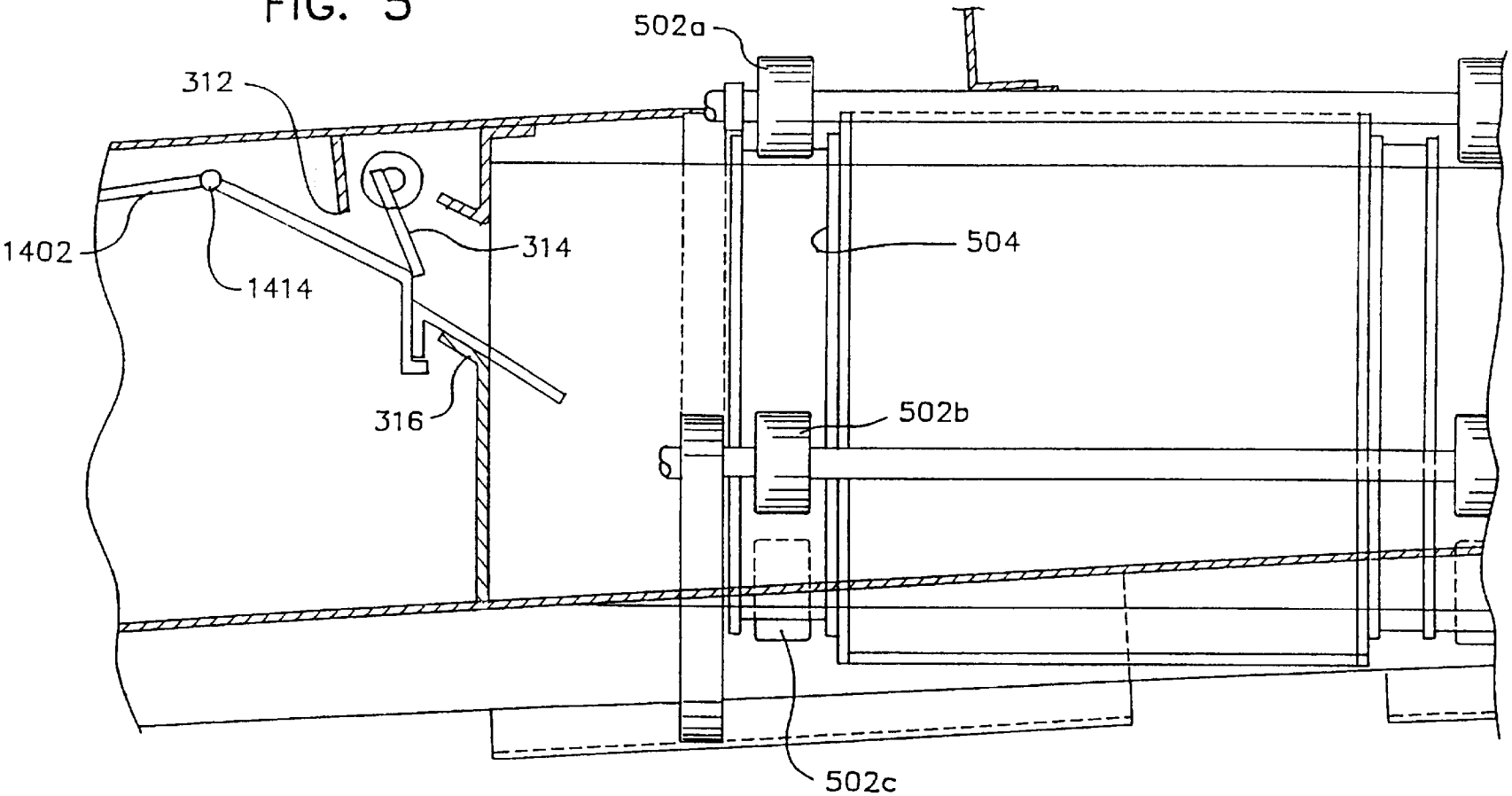
FIG. 5 is a partial side view of a tumbler device according to an embodiment of the present invention.
Figure 7:
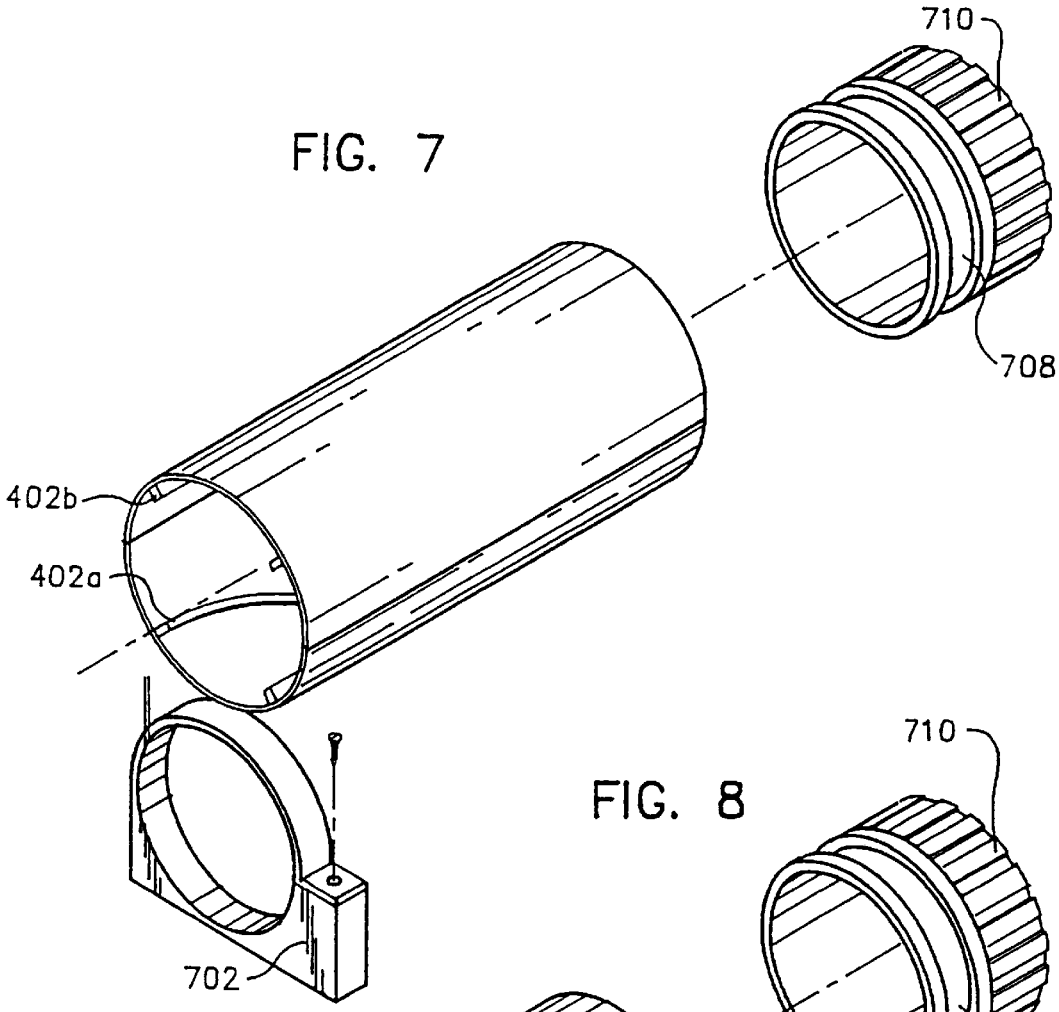
FIG. 7 is a partial perspective view, partially exploded, of a tumbler device according to an embodiment of the present invention.
Figure 8:
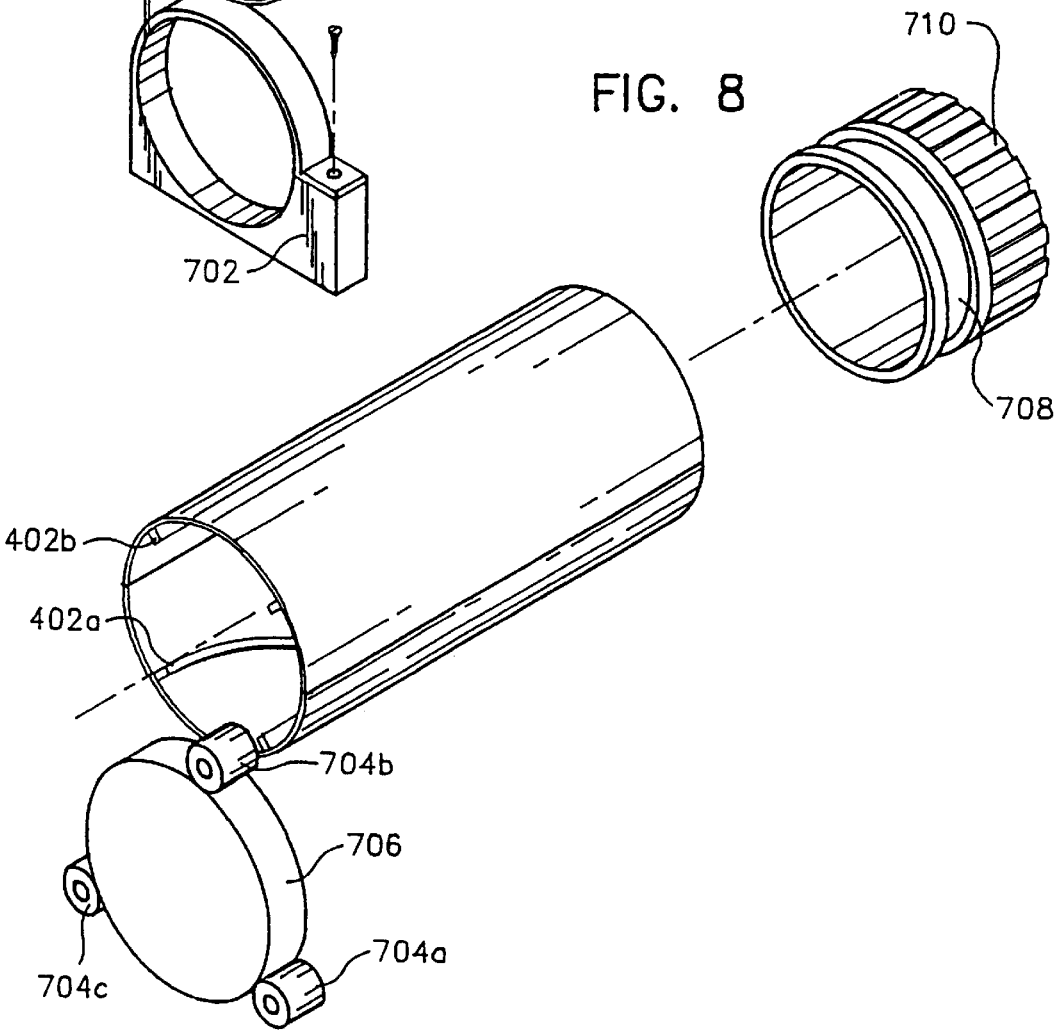
FIG. 8 is a partial perspective view, partially exploded, of a tumbler device according to an embodiment of the present invention.

Preferably, one or more protrusions are provided extending inwardly into the interior of the cylinder 318. As depicted in FIG. 4, a helical blade 402 may be provided. The blade assists in moving the coins such as by lifting coins from a lower position to a higher position, and releasing the lifted coin on the upper level of the coins in cylinder 318, as the cylinder 318 is rotated 322. Further, in the depicted embodiment, the blade, being helical-shaped 402, acts to convey the coins in a direction 332 toward later or downstream apparatus such as a hopper 334. In this fashion, even though in the embodiment of FIG. 3 the axis 324 of the cylinder 318 is horizontal, coins may be moved in a direction 332, without the need for relying on a gravity feed. Such a configuration is useful in order to minimize the vertical extent 336 required for the device. If desired, however, the tumbler cylinder 318 may be tilted, e.g. as in FIG. 5, and, if desired, a gravity feed may be used to assist in moving coins.

Various materials may be used for forming or coating the interior surface and/or projections 402 of cylinder 318. A low friction or non-stick material such as Teflon may be used to avoid unwanted adhesion of coins or non-coin matter to the tumbler 318. In one embodiment, the surfaces that will come in contact with the coins and non-coin matter will be chemically resistant and inert, to avoid corrosion and/or reaction with materials that may be introduced into the tumbler 318. In one embodiment, the surfaces are durable since they will be constantly impacted by the coins and other materials. Wear-resistant materials that may be used include silicon carbide, or other ceramic material steel, carbon-impregnated or carbon fiber or fiber-impregnated metals or ceramics or carbon impregnated foam, titanium, aluminum or other metals, nylon, polyvinyl chloride or other plastics or resins, and the like. In one embodiment the tumbler 318 is provided with materials for adsorbing, absorbing trapping or dissipating moisture, oils, finely divided particles, and the like. In one embodiment fins, blades or surfaces of the tumbler 318 are designed to abrade away over time, and are formulated to include materials which may assist in conditioning, cleaning, polishing, or otherwise conditioning the coins. For example, dry silicon lubricants may be included in the formulation, or abrasives for assisting or polishing coins. In one embodiment the fins, blades or other projections are removable so that they can be replaced or changed in shape or materials, as desired, to improve mechanical action, abrasion, polishing or other characteristics, or if replacement is required because of wear. Even if the projections or surfaces of the tumbler do not impart an abrasive material, it is believed that some abrasive or polishing action of the coins against each other will be achieved. It is believed that a material that self-destructs or disintegrates over time not only indicates wear, but also can be used for imparting cleaning abrader to not only help clean the coins, but eventually clean transport mechanisms, hoppers, sensors, sorting and counting mechanisms and other mechanisms throughout the machinery.

A number of devices for accommodating rotation of the tumbler 318 can be used. The tumbler assembly may be supported by a pillow block 702 (FIG. 9), a roller-supported 704*a,* 704*b,* 704*c* end cap 706, or may be provided with rollers or roller bearings 502*a,* 502*b,* 502*c,* or a bracket engaging a race or annular recess 504, or other bearing surface 708. If desired, one or more rollers 502a may be pivotable or spring loaded 524, e.g., to accommodate installation or removal of the cylinder 318, e.g., for maintenance, repair, inspection, and the like. It is particularly desirable that the tumbler be configured for ease of removal so that it can be easily cleaned or replaced or jams may be cleared.

Figure 9:
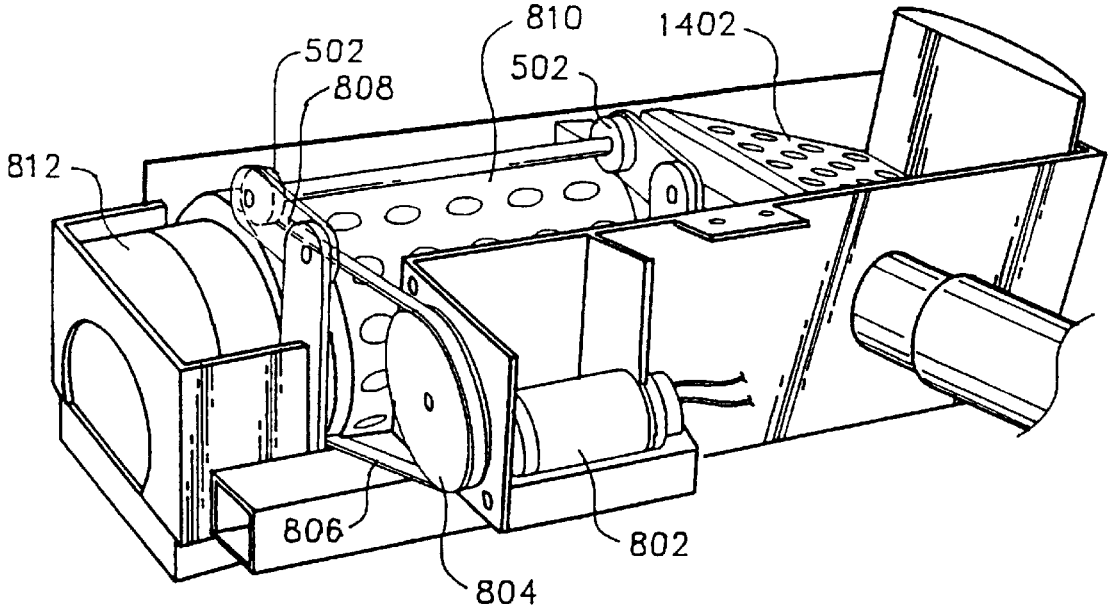
FIG. 9 is a rear perspective view of a modular feed way/tumbler device according to an embodiment of the present invention, which may be incorporated into the apparatus of FIG. 1.
Figure 10:
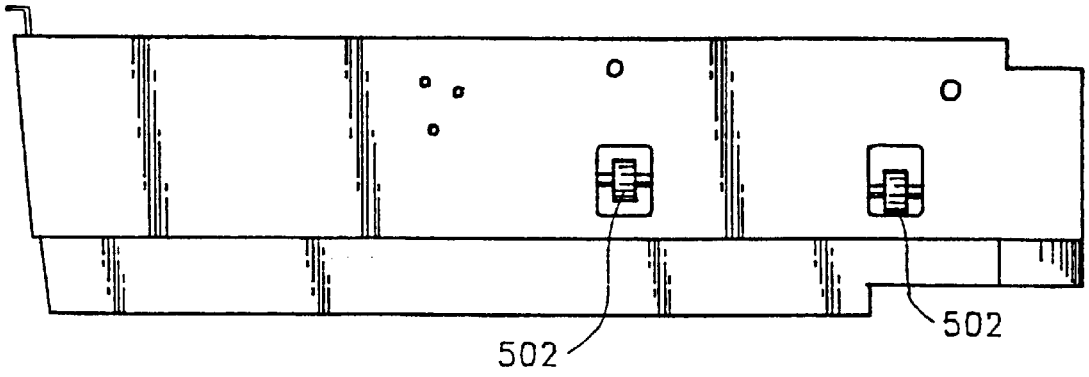
FIG. 10 is a side view of the apparatus of FIG. 9.
Figure 11:
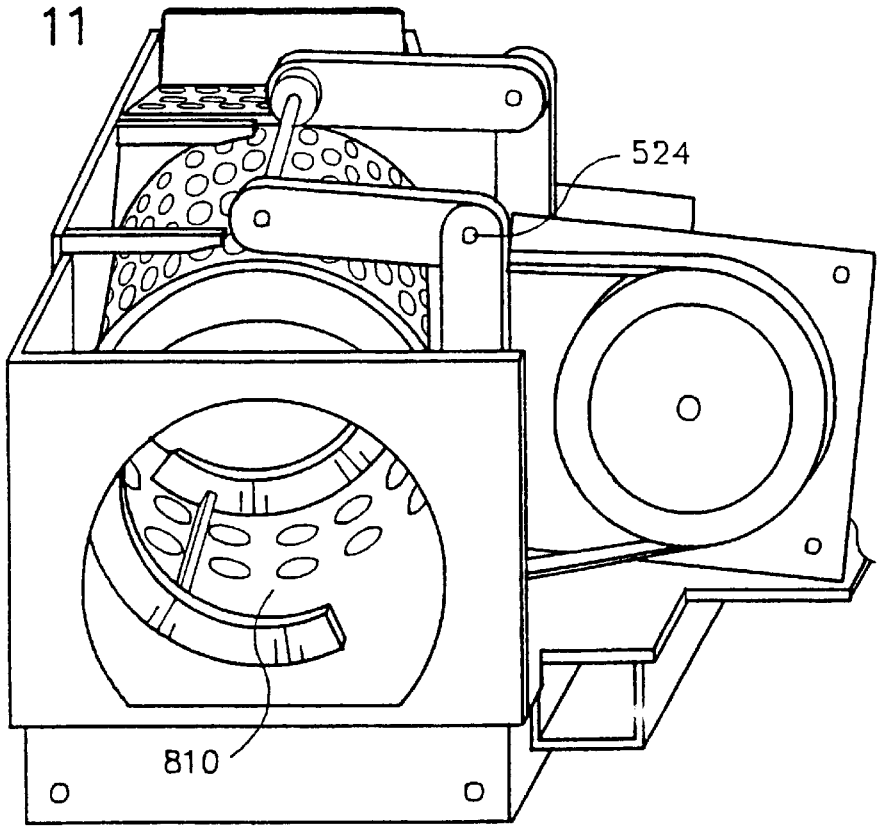
FIG. 11 is an end perspective view of the apparatus of FIG. 9.
Figure 12:
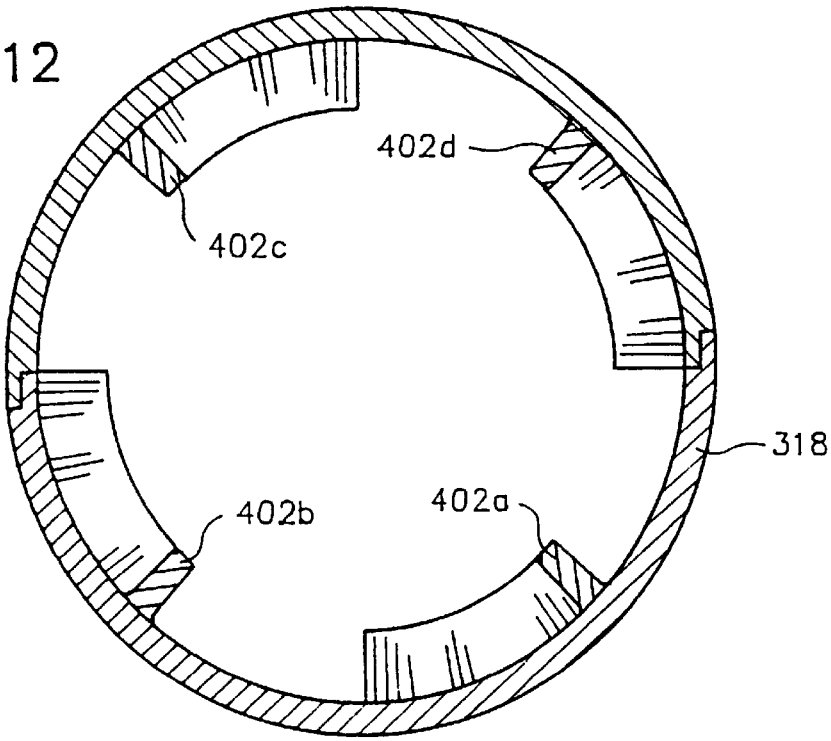
FIG. 12 is an end view of a tumbler cylinder, according to an embodiment of the present invention.

A number of devices may be provided for driving the rotationally-counted cylinder. The cylinder may be coupled to a toothed pulley or gear 710. The toothed pulley or gear 710 may be driven via a gear train or a toothed belt, such as a timing belt, coupled to a motor, such as an alternating current or DC gear motor. In the embodiment of FIG. 9, an alternating current gear motor 802 has a shaft that connects to a pulley 804 for driving a toothed belt 806, which engages a pulley such as a toothed pulley 808, coaxial with the perforated cylinder 810. Suitable belts, motors or pulleys can be obtained, e.g. from SDT components company.

In one embodiment, materials which move through the perforations 326, are received in a tray or other receiving area, preferably one which may be easily removed for emptying and/or cleaning 338. Although in the embodiment depicted in FIG. 3 the tray 338 receives materials expelled from only the tumbler 318, and a separate tray 343 receives materials which moves through the perforations of the tilting tray 1402, if desired, a single tray or other receptacle can be provided for both purposes.

Preferably, the tumbler 318 or tumbler assembly is grounded appropriately to avoid static electric charge buildup, which could have the adverse effect of attracting certain non-coin materials to the drum. Conductive or non-static coatings or components may be used in constructing the drum 318. Preferably all materials along the coin path and tumbler are conductive and grounded. In one embodiment, a multi-fingered conductive charge gatherer, similar to a Christmas garland, may be used to collect and/or dissipate static.

In one embodiment, the apparatus is configured to provide a flow of air or other fluid past the contents of the tumbler to assist in removing lighter and low-density non-in material Air flow devices may include a positive pressure device, a negative pressure or vacuum device, or both, although it is believed that a vacuum system may, in some environments, create an undesirable amount of noise. Preferably, in the case of a vacuum, a filter or filter bag is provided for capturing materials. Positive pressure air may be configured to pass through a filter on the feed end 342 of the tumbler chamber. In one embodiment, cleanse air is flushed through the system and additional air flow is used to dissipate moisture and heat. A suitable filtering system may be obtained from Nikro Industries, Villa Park, Ill. 60181. In one embodiment, a filter is used conforming to specifications: 88 inches of water lift, 95 cubic feet per minute, 1.25 horsepower, meeting MIL-P-51009 and MIL-F-5068B. An example is model number DC00288

In one embodiment a low back-pressure air transfer system may be used. In this system, a fan is mounted adjacent the coin-exit end of the tumbler 344, and a suction hose is positioned adjacent the coin-input end 342. The intake end of the suction hose may be screened or filtered to avoid damage to fans or other devices that power of the suction. Preferably there is little back pressure in the system and a relatively large amount of air is moved through as the coins are tumbled. In one embodiment the perforated cylinder 326 is enveloped and sealed with a housing to assist in directing air flow in the desired counter-current direction 334. The housing may be in the form of a semi-cylinder covering which seals with a waste removal tray 338. Such a housing preferably also is useful in diminishing or deadening the noise of the tumbler device.

In one embodiment the system is substantially modular such as being contained along with a feed tray 1402, in a rectangular or other modular housing 312. Preferably the modular design is configured to accommodate retrofitting in devices which do not currently have a tumbler. For example, a device such as that depicted in FIG. 1 may be retrofitted by removing the rectangular housing depicted in FIG. 2 and replacing with the rectangular modular unit of FIGS. 8 through 11. In one embodiment the tubular tumbler is formed from two semi-cylindrical mating polyurethane components.

The present invention includes a number of features and embodiments. According to one embodiment, the invention includes a coin agitator for use in separating non-coin matter from coins for use in a coin counting device prior to transfer of said coins to a sensor mechanism of said coin counting device including a container with at least a first opening. In this embodiment, the coin agitator may include a tube. The tube may be movable by being rotatable substantially about its longitudinal axis. The tube may be perforated. A perforated tube may have a largest perforation size configured to prevent passage of a smallest desired coin. A plurality of projections may extend inwardly from a surface of said coin agitator. The agitator may include at least a first helical vane. The agitator may include at least a first fan configured for producing air flow through said coin agitator.

According to one embodiment, a coin conditioning apparatus for use in a coin discriminating may include a device for receiving a plurality of coins in a first region and for tumbling said received coins to assist in separating non-coin material; and a device for moving said coins through said receiving device. The apparatus may include a device for causing a fluid to flow through said receiving means during said tumbling. The apparatus may include a device for imparting a coin conditioning material into said plurality of coins. In o(e embodiment, said coin conditioning material is selected from the group consisting of a lubricant and an abrasive. In one embodiment, said coin conditioner is substantially modular to accommodate retrofitting. The apparatus may include a device configured to direct air flow in a direction counter-current to at least a fir&t direction of coin movement. The apparatus may include a housing encompassing said coin conditioning device for reducing perceivable noise. The apparatus may include a positive pressure device for causing air flow through said coin conditioner. The apparatus may include a vacuum device for providing air flow through said coin conditioning.

In one embodiment, the invention provides a method for cleaning coins including:

- introducing said coins into a rotatably mounted tube having sidewall perforations;
- rotating said tube about its longitudinal axis to dislodge non-coin material;
- moving coins in a first longitudinal direction through said rotating tube; and
- flowing air through said rotating tube.

In light of the above description, a number of advantages of the present invention can be seen. The embodiment of FIGS. 13 through 21 is believed to particularly provide for thorough and efficient cleaning of coins while maintaining relatively high throughput, relatively low noise, and providing for ease of maintenance, replacement, inspection, and/or cleaning. This embodiment is useful in avoiding adhesion or slowing of coins along the depicted coin path by reducing or minimizing the potential for surface-to-surface contact of a coin with surfaces of the device. The device is relatively inexpensive to design, fabricate, construct, install and/or maintain, with many of the components being configured so that they may be formed by standard plastics or sheet metal fabrication processes such as stamping, drilling, injection molding and the like. Preferably the device is constructed with a shape, dimension and "footprint" that is compatible with earlier or in-service devices to permit ease of upgrading existing in-service devices, or ease of converting production facilities from production of existing devices, to production of devices according to the present invention.

The present invention provides an economical system and method for delivering clean coins to improve accuracy, durability and reliability of systems that identify, count, sort, discriminate and/or process coins and reducing jamming in input feed, transport and/or hopper devices. This system provides a system and method for self cleaning of a self-service coin processing device. The invention drives a tumbling mechanical agitation system for removing non-coin debris. The system reduces or eliminates the need for special services such as continually stopping a coin-counting device in order to perform maintenance of the identification, counting, sorting or transport components. The system preferably provides for wear indicating components such as wear indicating inner fins or other projections inside a tumbler. Preferably, the projections or other tumbler components are capable of imparting lubricants and/or abrasives or abrasive compounds. Preferably, the system provides a liquid or moisture removal system within the tumbler for removal of excess moisture or liquids, oils and the like, e.g., through an absorbent, adsorbent or desiccant component or feature of the tumbler fins or surfaces. In one embodiment, components are provided for dislodging or removing trapped items such as a floating or loose inert for dislodging items (such as a ball or other item which is too large to exit the exit hole) and/or finger rakes for dislodging trapped and/or dropped items.

A number of variations and modifications of the invention can be used. Although the invention is principally described as being useful in connection with cleaning coins, some or all features of the present invention can be used in connection with cleaning other types of devices such as regularly shaped items (e.g., golf balls), irregularly shaped items (such as screws, nuts, bolts, nails, and the like), and similar manufactured items. Although in one embodiment the device is controlled by a computer, other control devices can be used such as non-programmable or hard-wired control devices, application specific integrated circuits (ASICS), and the like. Although, in the above, items which are retained within the walls of the trommel are described as the objects to be cleaned and material passing through the holes in the walls of the trommel are described as "dirt," the device can be used in the opposite fashion, i.e. to recover relatively small valuable objects that pass through the holes of the trommel walls and discarding the large objects retained within the walls of the trommel. Similarly, the device can be used to separate large objects from small objects, neither of which is to be discarded.

In the above description, a number of surfaces (such as the chute surfaces and trommel interior surfaces) are provided with features which are believed to assist in avoiding the slowing or stopping of coin movement or flow (such as may result from friction, adhesion, surface tension or the lice). These features may include dimples, surface curvature, ridges, holes and the like, and are believed to operate by reducing or eliminating surface-to-surface contact between a coin face and a surface of the apparatus. In general, any or all of these features may be used on any or all of the apparatus surfaces that are coin-contact surfaces, such that, for example the first and/or second chutes may be provided with dimples or ridges (with or without the curvature described above), or the trommel interior surface may be provided with a degree of curvature (with or without the dimples described above.)

In addition to, or in place of, moving coins by providing a rotatable cylinder, other types of movement of the tubular or concave surface may also be used for moving or agitating the coins, such as a rocking or tilting motion, a swinging motion, a vibrating motion, and the like. Although, in one embodiment, a circular cross-section tumbler is depicted, other shapes may be used in this embodiment such as triangular, square, pentagonal, hexagonal, octagonal, or other polygonal cross-section tubing, conical or parabolic-sided or other tapering or flaring tubing and the like. In one embodiment it would be possible to provide a separation device which is U-shaped and, rather than being rotated 322, is driven to swing through an arc or tilt in order to agitate the coins. While it is preferred to provide perforations in the tube of the concave surface, it is also possible to provide an embodiment in which a tube or concave surface is unperforated, and air flow is used for removing materials dislodged during tumbling, e.g., when only lightweight or low-density contaminants are anticipated. If desired, the vanes, fins or other agitating/moving devices may be separate from or movable with respect to the tubular or concave surface. It is possible to rotate or otherwise move the fins relative to either a fixed or rotating tube, including rotating the tube and fins in opposite directions. If desired, the tubular or concave surface and/or the projections may be coated with or may incorporate substances or surfaces to assist in cleaning, polishing or otherwise conditioning the coins, such as absorbent or adsorbent materials for removing liquids, oils, finely divided particles, and the like, or materials for transferring lubricants, abrasives, polishing compounds, and the like, to the coins. The tubular or concave surface or projections may incorporate or provide materials for reducing friction, avoiding static electric charges, avoiding corrosion, and the like. The tumbler and/or housing may be made from or may include anechoic, sound-deadening and/or anti-static material. The drum, internal vanes, etc. can be connected to a transmission and/or speed reducer that is computer controlled, e.g. to adjust tumbling speed based on sensed temperature, humidity, load weight, and/or in-feed or out-feed rate, or to suspend out-feed, e.g. in response to a sensed jam or other malfunction. If desired, a flow of air or other gases or, if desired, liquids, aerosols, mists, gels, and the like, may be introduced, preferably in a counter-current fashion with respect to the coin flow, to assist in conditioning the coins, e.g. by removing non-coin objects, Epcily small or light-weight non-coin matter such as hair and dust. A pressurized air and/or vacuum system may be used for causing such flow. If desired, filters may be provided for trapping some removed materials. In one embodiment, a cylindrical body having vanes rising from the inner diameter and a plurality of openings is used. If desired, it would be possible to construct a device in which the perforated surface is maintained stationary, and a separate screw drive or other drive agitates and moves the coins to or across the stationary surface.

Although the invention has been defined by way of a preferred embodiment and certain variation modifications, other variations and modifications can also be used.

What is claimed is:

1. In a coin discriminating device, an apparatus for cleaning a mass of items, including a plurality of desired coins of various diameters, prior to conveyance to a coin discriminator, wherein none of said desired coins is smaller than a predetermined smallest desired coin, to define a minimum coin diameter, and none of said desired coins is larger than a predetermined largest desired coin, to define a maximum coin diameter, the apparatus comprising:

a container having at least a first opening, larger than said maximum coin diameter, for admitting a first plurality of said mass of items and a plurality of second openings, smaller than said first opening, for permitting exit of dirt from said container without having first passed through a container opening smaller than said maximum coin diameter, each of said second openings being smaller than said minimum diameter to prevent passage of an of said plurality of desired coins through any of said plurality of second openings, wherein said container does not discriminate between said various diameters of said desired coins;

a driver, coupled to said container, so as to move said container and agitate said first plurality of said mass of items wherein, following agitating said first plurality of said mass of items, said plurality of desired coins is conveyed from said container to said coin discriminator for discriminating said desired coins of various diameters;

a third opening, larger than said second opening, permitting coins to exit said container;

a first endpiece coupled to said container adjacent said first opening and defining a coin entry opening, wherein said first endpiece is manually removable from said container, without the use of tools; and a second endpiece coupled to said container adjacent said third opening and defining a coin exit opening, wherein said second endpiece is manually removable from said container, without the use of tools.

2. Apparatus, as claimed in claim 1, further comprising means to prevent coupling said first endpiece adjacent said third opening.

3. Apparatus, as claimed in claim 1, wherein at least one of said first and second endpiece includes a bearing to accommodate rotation of said container.

4. Apparatus, as claimed in claim 1 wherein at least one of said first and second endpiece includes a component of a transmission system for coupling said driver to said container.

5. Apparatus, as claimed in claim 4, wherein said component comprises a gear.

6. In a coin discriminator, an apparatus for cleaning a mass of coins prior to conveyance to a coin discriminator, comprising:

a container having at least a first opening for admitting a first plurality of said mass of coins and a second opening, smaller than said first opening, for permitting exit of dirt from said container;

a third opening permitting coins to exit said container;

a first endpiece coupled to said container adjacent said first opening and defining a coin entry opening;

a second endpiece coupled to said container adjacent said third opening and defining a coin exit opening;

said first endpiece having a resilient tab and slot system, configured differently from a corresponding tab and slot system employed with said second endpiece and third opening, to prevent coupling said first endpiece adjacent said third opening; and a driver, coupled to said container so as to rotate said container about an axis of said container and agitate said first plurality of coins.

7. In a coin discriminating device, an apparatus for cleaning a mass of items, including a plurality of desired coins of various diameters, prior to conveyance to a coin discriminator, wherein none of said desired coins is smaller than a predetermined smallest desired coin, to define a minimum coin diameter, and none of said desired coins is larger than a predetermined largest desired coin, to define a maximum coin diameter, the apparatus comprising:

a cleaner which includes at least a first container, said cleaner having cleaner openings, which include at least a first opening, larger than said maximum coin diameter, for admitting a first plurality of said mass of items, a plurality of second openings in said cleaner, smaller than said first opening for permitting exit of dirt from said cleaner without having first passed through a cleaner opening smaller than said maximum coin diameter, each of said second openings being smaller than said minimum diameter to prevent passage of any of said plurality of desired coins through any of said plurality of second openings, wherein said cleaner does not discriminate between said various diameters of said desired coins, and a third opening, larger than said maximum coin diameter, for allowing said first plurality of said mass of items to exit the cleaner;

a driver, coupled to said container, so as to move said container and agitate at least some of said first plurality of said mass of items;

wherein, following agitating said first plurality of said mass of items, all of said plurality of desired coins admitted to said cleaner through said first opening as a part of said first plurality of said mass of items exits said cleaner through said third opening, and wherein said plurality of desired coins is conveyed from said container to a coin discriminator for discriminating said desired coins of various diameters; and at least a first vane protruding inwardly from an interior surface of said container and at least a second vane protruding inwardly from an interior surface of said container.

8. In a coin discriminating device, an apparatus for cleaning a mass of coins prior to conveyance to a coin discriminator, comprising:

a container having a longitudinal axis and having at least a first opening for admitting a first plurality of said mass of coins and a second opening, smaller than said first opening, for permitting exit of dirt from said container; and a driver, coupled to said container so as to move said container and agitate said first plurality of coins about said longitudinal axis;

at least a first vane protruding inwardly from an interior surface of said container and said first vane including at least first and second segments, defining a first node therebetween, wherein at least a first portion of said first segment is laterally displaced in a first direction from a second portion of said first segment and wherein at least a part of said second segment is laterally displaced from said second portion of said first segment in a direction opposite to said first direction;

at least a first dimple protruding inwardly from said interior surface of said container.

9. Apparatus, as claimed in claim 8, further comprising at least a second vane protruding inwardly from an interior surface of said container wherein said second vane includes at least third and fourth segments, defining a second node therebetween, wherein at least a first portion of said third segment is laterally displaced in a second direction from a second portion of said third segment and wherein at least a part of said fourth segment is laterally displaced from said second portion of said third segment in a direction opposite to said second direction, and wherein said second node is longitudinally displaced from said first node.

10. In a coin discriminating device, an apparatus for cleaning a mass of coins prior to conveyance to a coin discriminator, comprising:

a container having at least a first opening for admitting a first plurality of said mass of coins and a second opening, smaller than said first opening, for permitting exit of dirt from said container, said container having an interior surface with a plurality of dimples, protruding inwardly from the interior surface of said container, and said interior surface bearing a plurality of vanes protruding inwardly from said interior surface, and a driver, coupled to said container so as to move said container and agitate said first plurality of coins.

11. In a coin discriminating device, an apparatus for cleaning a mass of coins prior to conveyance to a coin discriminator, comprising:

a container having at least a first opening for admitting a first plurality of said mass of coins and a second opening, smaller than said first opening, for permitting exit of dirt from said container, and having an interior surface with a plurality of dimples, a driver, coupled to said container so as to move said container and agitate said first plurality of coins, and an entryway for permitting coins to enter into said container, which includes a first upwardly projecting wall and a second downwardly projecting wall, spaced from said upwardly projecting wall such that a rigid elongate object having a maximum linear dimension greater than about 2.5 inches can not entirely pass beyond said first wall.

12. In a coin discriminating device, an apparatus for cleaning a mass of items including a plurality of desired coins of various diameters prior to conveyance to a coin discriminator, wherein none of said desired coins is smaller than a predetermined smallest desired coin, to define a minimum coin diameter, and none of said desired coins is larger than a predetermined largest desired coin, to define a maximum coin diameter, the apparatus comprising:

a container, defining a container interior space, and having at least a first means for admitting a first plurality of said mass of items and a plurality of second openings, smaller than said first means, for permitting exit of dirt and items having a diameter less than said minimum coin diameter from said container, without having first passed through a container opening smaller than said maximum coin diameter, each of said second openings being smaller than said minimum diameter to prevent passage of any of said plurality of desired coins through any of said plurality of second openings;

motive means, coupled to said container, for moving said container so as to cause at least some of said first plurality of coins to fall through a portion of said container interior space; and means for conveying at least some of said first plurality of coins from said container to said coin discriminator for discriminate said coins of various diameters;

means for preventing face-to-face contact between an entire face of one of said plurality of coins and an interior surface of said container, wherein said means for preventing comprises protrusions, extending inwardly from the interior surface of said container.

13. A method for cleaning a plurality of desired coins, comprising:

providing a frame;

providing at least a first container having a first entry opening sized and positioned to permit entry of any of said plurality of desired coins into said container, and a second exit opening, sized and positioned to permit exit of any of said plurality of desired coins from said container and further having a plurality of holes, all of said plurality of holes being of a smaller diameter than any of said plurality of desired coins to prevent passage therethrough of any of said plurality of desired coins;

mounting said first container to said frame to permit rotation of said container about said first axis;

introducing said plurality of coins into said first container;

rotating said first container about said first axis; and conveying at least some of said first plurality of coins from said first container to a coin discriminator for discriminating between particular denominations of desired coins;

effecting removal of said plurality of coins from said container, after at least some dirt has passed through at least some of said plurality of holes during said step of rotating; and providing at least a first vane adjacent an interior surface of said container, to assist in said step of effecting removal of said plurality of coins.

14. In a coin discriminating device, an apparatus for cleaning a mass of items, including a plurality of desired coins of various diameters, prior to conveyance to a coin discriminator, wherein none of said desired coins is smaller than a predetermined smallest desired coin, to define a minimum coin diameter, and none of said desired coins is larger than a predetermined largest desired coin, to define a maximum coin diameter, the apparatus comprising;

a container having at least a first opening, larger than said maximum coin diameter, for admitting a first plurality of said mass of items and a plurality of second openings, smaller than said first opening, for permitting exit of dirt from said container without having first passed through a container opening smaller than said maximum coin diameter, each of said second openings being smaller than said minimum diameter to prevent passage of any of said plurality of desired coins through any of said plurality of second openings, wherein said container does not discriminate between said various diameters of said desired coins;

a driver, coupled to said container, so as to move said container and agitate said first plurality of said mass of items;

wherein, following agitating said first plurality of said mass of items, said plurality of desired coins is conveyed from said container to said coin discriminator for discriminating said desired coins of various diameters;

a trough defining an upper surface, sized to accept said plurality of coins, and having a first entry edge and a second, opposed, exit edge, defining a longitudinal axis extending in a direction having a component from said en edge toward said exit edge;

said upper surface having a curvature in at least a first direction, over the entirety of said upper surface, said curvature sufficient to avoid surface-tension adhesion between said surface and any of said plurality of coins; and at least a first pin protruding from said upper surface.

15. A trommel, Comprising:

at least a first portion and a second concave portion having a first length coupled to said first portion by a first hinge having a first axis, said first portion having an edge, opposite said first hinge which to permit said trommel to be reconfigured between a first open configuration defining an opening extending said entire first length and a second closed configuration said closed configuration defines a cross-sectional perimeter of said trommel, wherein said first portion covers said opening, said edge, in said closed configuration being at a position of said cross-sectional perimeter which is substantially diametrically opposite said first axis.

16. A trommel, as claimed in claim 15, wherein said trommel, when in said closed configuration, has an interior surface, and wherein, when said trommel is in said open configuration, substantially all of said interior surface is accessible.

17. A trommel, as claimed in claim 15, wherein said first and second portions are rotatably coupled, defining a first side axis.

18. A trommel, as claimed in claim 17, said trommel is coupled to a driver for rotation about a rotation axis and wherein said first side axis is substantially parallel to said rotation axis.

19. A trommel, as claimed in claim 15, wherein at least one of said first and second portions comprises first and second walls meeting at an angle.

20. A trommel, as claimed in claim 15, further comprising at least a first latch, releasably holding said first and second portions in said closed configuration.

21. In a coin discriminating device, an apparatus for cleaning a mass of items, including a plurality of desired coins of various diameters, prior to conveyance to a coin discriminator, wherein none of said desired coins is smaller than a predetermined smallest desired coin to, define a minimum coin diameter, and none of said desired coins is larger than a predetermined largest desired coin, to define a maximum coin diameter, the apparatus comprising:

a container having at least a first opening, larger than said maximum coin diameter, for admitting a first plurality of said mass of items and a plurality of second openings, smaller than said first opening, for permitting exit of dirt from said container without having first passed through a container opening smaller than said maximum coin diameter, each of said second openings being smaller than said minimum diameter to prevent passage of any of said plurality of desired coins through any of said plurality of second openings, wherein said container does not discriminate between said various diameters of said desired coins; and a driver, coupled to said container, so as to move said container and agitate said first plurality of said mass of items;

wherein, following agitating said first plurality of said mass of items, said plurality of desired coins is convened from said container to said coin discriminator for discriminating said desired coins of various diameters, wherein said container has an interior surface and the interior surface of said container includes substantially flat walls, and wherein said container includes four walls to define a quadrilateral interior cross section.

22. A coin discriminating device comprising:

a first pivotable feed tray inclined in a first direction pivotable about a first pivot axis and configured to move coins therein over a ridge defined by said pivot axis;

a coin conditioner configured to receive coins moved over said ridge and tumble said coins with respect to one another for dislodging non-coin materials and to permit exit of all of the coins received through at least a first opening in said coin conditioner said coin conditioner having a plurality of holes to permit exit of non-coin materials, said plurality of holes having a size small enough to prevent passage therethrough of any of said coins;

a hopper for receiving coins from said coin conditioner;

a coin discriminator, including a plurality of sensors, for receiving coins from said hopper and discriminating at least a first coin denomination from a second coin denomination; and output means for providing output indicating a number of at least a first coin denomination.

* * * * *

UNITED STATES PATENT AND TRADEMARK OFFICE

CERTIFICATE OF CORRECTION

PATENT NO. : 6,174,230 B1
DATED : January 16, 2001
INVENTOR(S) : Gerrity et al.

It is certified that error appears in the above-identified patent and that said Letters Patent is hereby corrected as shown below:

Column 1,
Line 15, insert the word -- by -- prior to the word "reference."
Line 40, delete the word "inportant" and substitute the word -- important -- therefor.

Column 2,
Line 52, the language "way/tumbler" should be deleted and -- tray/tumbler -- substituted therefor.
Line 64, the word "perceive" should be deleted and the word -- perspective -- substituted therefor.

Column 3,
Line 35, the word "of" should be deleted and the word -- or -- substituted therefor.
Line 59, the word "thought" should be deleted and the word -- through -- substituted therefor.

Column 4,
Line 22, the word "otherwise" should be deleted and the word -- transmissions -- substituted therefor.
Line 43, the word "More" should be deleted and the word -- more -- substituted therefor.

Column 5,
Line 43, the words "tile trammel" should be deleted and the words -- the trommel -- substituted therefor.
Line 50, the word "as" should be deleted and the word -- axis -- substituted therefor.

Column 6,
Line 6, the word "comers" should be deleted and the word -- corners -- substituted therefor.
Line 44, the word "&bout" should be deleted and the word -- about -- substituted therefor.
Line 48, the word "hole" should be deleted and the word -- holes -- substituted therefor.

Column 7,
Line 13, the word "grace" should be deleted and the word -- surface -- substituted therefor.
Line 33, the designator "16" should be deleted and the designator -- 1316 -- substituted therefor.
Line 34, the word -- closed -- should be inserted prior to the word "configuration."
Line 56, the word "comers" should be deleted and the word -- corners -- substituted therefor.

UNITED STATES PATENT AND TRADEMARK OFFICE

CERTIFICATE OF CORRECTION

PATENT NO. : 6,174,230 B1
DATED : January 16, 2001
INVENTOR(S) : Gerrity et al.

It is certified that error appears in the above-identified patent and that said Letters Patent is hereby corrected as shown below:

Column 7, cont'd,
Line 57, immediately following the words "lifting/free-fall" the punctuation mark -- . -- should appear.
Line 60, the word "comers" should be deleted and the word -- corners -- substituted therefor.
Line 62, the word "comers" should be deleted and the word -- corners -- substituted therefor.

Column 8,
Line 22, the designator "1929*d*" should be deleted and the designator -- 1928*d* -- substituted therefor.
Line 30, the word "coils" should be deleted and the word -- coins -- substituted therefor.

Column 9,
Line 31, immediately following the word "direction" the punctuation mark -- . -- should appear.
Line 53, the letters "USC" should be deleted and the word -- use -- substituted therefor.

Column 10,
Line 6, the word "maybe" should be deleted and the words -- may be -- substituted therefor.
Line 25, the designator "1126" should be deleted and he designator -- 1326 -- substituted therefor.
Line 25, the word "We" should be deleted and the word -- the -- substituted therefor.
Line 33, the word "lot" should be deleted and the word -- first -- substituted therefor.
Line 52, immediately following the word "coins" the punctuation mark "," should be deleted and the punctuation mark -- . -- substituted therefor.

Column 11,
Line 12, the word "jars" should be deleted and the word -- jam. -- substituted therefor.
Line 52, the word "length" should be deleted and the word -- strength -- substituted therefor.
Line 57, the word "ma" should be deleted and the word -- area -- substituted therefor.

Column 12,
Line 44, immediately following the word "material" the punctuarion mark -- , -- should appear.

UNITED STATES PATENT AND TRADEMARK OFFICE

CERTIFICATE OF CORRECTION

PATENT NO. : 6,174,230 B1
DATED : January 16, 2001
INVENTOR(S) : Gerrity et al.

It is certified that error appears in the above-identified patent and that said Letters Patent is hereby corrected as shown below:

Column 13,
Line 17, the words "rotationally-counted" should be deleted and the words -- rotationally-mounted -- substituted therefor.
Line 49, the words "non-in" should be deleted and the words -- non-coin -- substituted therefor.
Line 49, immediately following the word "material" the punctuation mark -- . -- should appear.
Line 52, the characters "fir&t" should be deleted and the word -- first -- substituted therefor.
Lines 62-63, the language "MIL-P-51009" should be deleted and the language -- MIL-F-51079 -- substituted therefor.
Line 63, the language "MIL-F-5068B" should be deleted and the language -- MIL-F-51068B -- substituted therefor.

Column 14,
Line 47, the characters "o(e" should be deleted and the word -- one -- substituted therefor.

Column 16,
Line 5, the word "lice" should be deleted and the word -- like -- substituted therefor.
Line 62, the word "Epcily" should be deleted and the word -- especially -- substituted therefor.

Column 17, claim 3,
Line 52, the word "endpiece" should be deleted and the word -- endpieces -- substituted therefor.

Column 17, claim 4,
Line 55, the word "endpiece" should be deleted and the word -- endpieces -- substituted therefor.

Column 18, claim 7,
Line 27, immediately following the words "first opening" the punctuation mark -- , -- should be inserted.

Column 20, claim 12,
Line 9, the word "discriminate" should be deleted and the word -- discriminating -- substituted therefor.

UNITED STATES PATENT AND TRADEMARK OFFICE

CERTIFICATE OF CORRECTION

PATENT NO. : 6,174,230 B1
DATED : January 16, 2001
INVENTOR(S) : Gerrity et al.

It is certified that error appears in the above-identified patent and that said Letters Patent is hereby corrected as shown below:

Column 21, claim 14,
Line 7, the language "en" should be deleted and the word -- entry -- substituted therefor.

Column 21, claim 21,
Line 50, the words "coin to. define" should be deleted and the words -- coin, to define -- substituted therefor.

Column 22, claim 21,
Lines 20-21, the word "convened" should be deleted and the word -- conveyed -- substituted therefor.

Signed and Sealed this

Eighteenth Day of December, 2001

*Attest:*

*Attesting Officer*

JAMES E. ROGAN
*Director of the United States Patent and Trademark Office*